US011679603B2

(12) United States Patent
Saito et al.

(10) Patent No.: US 11,679,603 B2
(45) Date of Patent: Jun. 20, 2023

(54) LIQUID DISCHARGE APPARATUS AND IMAGE FORMING METHOD

(71) Applicants: Yosuke Saito, Kanagawa (JP); Daiki Marumo, Kanagawa (JP); Takahiko Sugiura, Kanagawa (JP); Shotaro Takeuchi, Kanagawa (JP)

(72) Inventors: Yosuke Saito, Kanagawa (JP); Daiki Marumo, Kanagawa (JP); Takahiko Sugiura, Kanagawa (JP); Shotaro Takeuchi, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 105 days.

(21) Appl. No.: 17/496,801

(22) Filed: Oct. 8, 2021

(65) Prior Publication Data

US 2022/0111666 A1 Apr. 14, 2022

(30) Foreign Application Priority Data

Oct. 9, 2020 (JP) ..... JP2020-171452
Aug. 30, 2021 (JP) ..... JP2021-139673

(51) Int. Cl.

| | |
|---|---|
| ***B41J 11/42*** | (2006.01) |
| ***B41J 25/00*** | (2006.01) |
| *B41J 2/21* | (2006.01) |
| *B41J 19/14* | (2006.01) |

(52) U.S. Cl.

CPC ..... *B41J 11/42* (2013.01); *B41J 25/006* (2013.01); *B41J 2/2132* (2013.01); *B41J 19/142* (2013.01)

(58) Field of Classification Search

CPC ..... B41J 25/006; B41J 19/142; B41J 19/145; B41J 19/202; B41J 2/01; B41J 2/04503; B41J 2/15; B41J 2/2132; B41J 11/008; B41J 11/42; G06K 15/105; G06K 15/102

See application file for complete search history.

(56) References Cited

U.S. PATENT DOCUMENTS

2005/0220523 A1* 10/2005 Fujimori ..... B41J 19/142 400/76
2008/0111852 A1* 5/2008 Yoshida ..... B41J 11/008 347/41
2013/0194336 A1* 8/2013 Iwadate ..... B41J 23/00 347/14

(Continued)

*Primary Examiner* — John Zimmermann
(74) *Attorney, Agent, or Firm* — Xsensus LLP

(57) ABSTRACT

A liquid discharge apparatus includes a conveyance roller, a liquid discharge head, and a control device. The control device controls the head to discharge liquid onto a medium X times in the main scanning direction and Y times in the sub-scanning direction and controls the roller such that a position of a droplet on the medium discharged by an m-th discharge and a position of another droplet on the medium discharged by an (m+Y)-th discharge are same in the sub-scanning direction, where m is an integer not smaller than one and not greater than ((X−1)×Y). Where P is a circumferential length of the roller and L is a difference in a conveyance distance in the sub-scanning direction when the m-th discharge is compared with the (m+Y)-th discharge, the following relation is satisfied:

$$L=(n+(\Delta\theta/2\pi))\times P,$$

where $|\pi-\Delta\theta|<60°$ and n is an integer.

7 Claims, 15 Drawing Sheets

(56) References Cited

U.S. PATENT DOCUMENTS

| | | | | |
|---|---|---|---|---|
| 2014/0153006 | A1* | 6/2014 | Yorimoto | B41J 2/2135<br>358/1.5 |
| 2019/0210386 | A1* | 7/2019 | Chang | B41J 2/2103 |
| 2022/0242152 | A1* | 8/2022 | Asada | B41J 13/0009 |

* cited by examiner

FIG. 6

| | | | | | | | | | | | |
|---|---|---|---|---|---|---|---|---|---|---|---|
| 12 | | | | | | | | | | | |
| 11 | 12 | | | | | | | | | | |
| 10 | 11 | 12 | | | | | | | | | |
| 9 | 10 | 11 | 12 | | | | | | | | |
| 8 | 9 | 10 | 11 | 12 | | | | | | | |
| 7 | 8 | 9 | 10 | 11 | 12 | | | | | | |
| 6 | 7 | 8 | 9 | 10 | 11 | 12 | | | | | |
| 5 | 6 | 7 | 8 | 9 | 10 | 11 | 12 | | | | |
| 4 | 5 | 6 | 7 | 8 | 9 | 10 | 11 | 12 | | | |
| 3 | 4 | 5 | 6 | 7 | 8 | 9 | 10 | 11 | 12 | | |
| 2 | 3 | 4 | 5 | 6 | 7 | 8 | 9 | 10 | 11 | 12 | |
| 1 | 2 | 3 | 4 | 5 | 6 | 7 | 8 | 9 | 10 | 11 | 12 |
| | 1 | 2 | 3 | 4 | 5 | 6 | 7 | 8 | 9 | 10 | 11 |
| | | 1 | 2 | 3 | 4 | 5 | 6 | 7 | 8 | 9 | 10 |
| | | | 1 | 2 | 3 | 4 | 5 | 6 | 7 | 8 | 9 |
| | | | | 1 | 2 | 3 | 4 | 5 | 6 | 7 | 8 |
| | | | | | 1 | 2 | 3 | 4 | 5 | 6 | 7 |
| | | | | | | 1 | 2 | 3 | 4 | 5 | 6 |
| | | | | | | | 1 | 2 | 3 | 4 | 5 |
| | | | | | | | | 1 | 2 | 3 | 4 |
| | | | | | | | | | 1 | 2 | 3 |
| | | | | | | | | | | 1 | 2 |
| | | | | | | | | | | | 1 |

FIG. 7

| | |
|---|---|
| 6 | 12 |
| 5 | 11 |
| 4 | 10 |
| 3 | 9 |
| 2 | 8 |
| 1 | 7 |

LIQUID DISCHARGE APPARATUS AND IMAGE FORMING METHOD

CROSS-REFERENCE TO RELATED APPLICATIONS

This patent application is based on and claims priority pursuant to 35 U.S.C. § 119(a) to Japanese Patent Application Nos. 2020-171452, filed on Oct. 9, 2020 and 2021-139673, filed on Aug. 30, 2021 in the Japan Patent Office, the entire disclosure of each of which is incorporated by reference herein.

BACKGROUND

Technical Field

Embodiments of the present disclosure relates to a liquid discharge apparatus and an image forming method.

Related Art

In the related art, as a method of performing printing by an inkjet recording apparatus serving as a liquid discharge apparatus, a multi-pass method is widely used that performs a main scanning operation a plurality of times with respect to each position on a medium. In a case where printing is performed by such a multi-pass method, the inkjet recording apparatus discharges ink droplets onto a region over which an inkjet head passes in each main scanning operation, while feeding a medium by a conveyance roller, to form an image. In each main scanning operation, discharge of ink droplets is performed in accordance with mask data having a preset pattern. However, a phenomenon called banding may occur due to, for example, coalescence of dots discharged during image formation or landing deviation.

Banding occurs due to the conveyance accuracy of a conveyance roller that conveys a medium, in addition to factors such as ink characteristics, the way in which an image is printed using a multi-pass method (mask), variations in head characteristics, and head mounting accuracy.

For this reason, a technology for correcting the conveyance amount of a medium based on correlation information so that the conveyance amount matches a target conveyance amount, in order to enhance the conveyance accuracy of the medium.

SUMMARY

According to an embodiment of the present disclosure, a liquid discharge apparatus includes a conveyance roller, a liquid discharge head, and a control device. The conveyance roller conveys a medium. The liquid discharge head includes a plurality of nozzles to discharge liquid onto the medium. The control device controls the conveyance roller and the liquid discharge head. The control device controls the conveyance roller and the liquid discharge head in a manner such that an operation of conveying the medium in a sub-scanning direction by a predetermined distance by the conveyance roller and stopping the medium and an operation of discharging the liquid from the plurality of nozzles onto the medium during movement of the liquid discharge head in a main scanning direction orthogonal to the sub-scanning direction are alternately performed; controls the liquid discharge head to discharge the liquid onto the medium X times in the main scanning direction and Y times in the sub-scanning direction for a total of X×Y times for each unit region corresponding to a nozzle pitch that is a pitch of the plurality of nozzles in the sub-scanning direction; and controls the conveyance roller to convey the medium in a manner such that a position of a liquid droplet on the medium discharged from a nozzle of the plurality of nozzles by an m-th discharge and a position of another liquid droplet on the medium discharged from another nozzle of the plurality of nozzles by an (m+Y)-th discharge are same in the sub-scanning direction, where m is an integer not smaller than one and not greater than ((X−1)×Y). Where P is a circumferential length of the conveyance roller and L is a difference in a conveyance distance of the medium in the sub-scanning direction when the m-th discharge from the plurality of nozzles is compared with the (m+Y)-th discharge from the plurality of nozzles, the following relation is satisfied:

$$L=(n+(\Delta\theta/2\pi))\times P,$$

where $|\pi-\Delta\theta|<60°$ and n is an integer.

According to another embodiment of the present disclosure, a multi-pass liquid discharge apparatus includes a conveyance roller and a liquid discharge head. The conveyance roller conveys a medium. The liquid discharge head includes a plurality of nozzles configured to perform a plurality of scans to discharge liquid to different positions on the medium conveyed by the conveyance roller, to form an image. When L is a distance between passes in a plurality of passes to be executed for printing in a main scanning direction, M is a number of nozzles present in the distance between passes, C is a number of nozzles in one scan, D is a number of nozzles used in a total of scans, E is a number of nozzles physically usable from a configuration of the liquid discharge head, and F is a feed amount per scan calculated from the nozzles physically usable, the following relations are satisfied: C=F; and D≤E. A sine wave generated by rotation of the conveyance roller has a phase difference of a half cycle for each pass.

According to still another embodiment of the present disclosure, a multi-pass liquid discharge apparatus includes a conveyance roller and a liquid discharge head. The conveyance roller conveys a medium. The liquid discharge head includes a plurality of nozzles configured to perform a plurality of scans to discharge liquid to different positions on the medium conveyed by the conveyance roller, to form an image. When L is a distance between passes in a plurality of passes to be executed for printing in a main scanning direction, M is a number of nozzles present in the distance between passes, C is a number of nozzles in one scan, D is a number of nozzles used in a total of scans, E is a number of nozzles physically usable from a configuration of the liquid discharge head, and F is a feed amount per scan calculated from the nozzles physically usable, the following relations are satisfied: C=F; and D≤E. An amplitude of a composite wave obtained by superimposing a first sine wave generated by rotation of the conveyance roller in formation of a first pass and a second sine wave generated by rotation of the conveyance roller in formation of a second pass is smaller than an amplitude of each of the first sine wave and the second sine wave.

According to still yet another embodiment of the present disclosure, there is provided an image forming method to be executed in a multi-pass liquid discharge apparatus. The method includes conveying a medium by a conveyance roller and performing a plurality of scans to discharge liquid from a plurality of nozzles of a liquid discharge head to different positions on the medium conveyed by the conveyance roller, to form an image. When L is a distance between passes in a plurality of passes to be executed for printing in a main scanning direction, M is a number of nozzles present in the distance between passes, C is a number of nozzles in one scan, D is a number of nozzles used in a total of scans, E is a number of nozzles physically usable from a configuration of the liquid discharge head, and F is a feed amount per scan calculated from the nozzles physically usable, the following relations are satisfied: C=F; and D≤E. A sine wave generated by rotation of the conveyance roller has a phase difference of a half cycle for each pass.

According to still yet further another embodiment of the present disclosure, there is provided an image forming method in a multi-pass liquid discharge apparatus, the method includes conveying a medium by a conveyance roller and performing a plurality of scans to discharge liquid from a plurality of nozzles of a liquid discharge head to different positions on the medium conveyed by the conveyance roller, to form an image. When L is a distance between passes in a plurality of passes to be executed for printing in a main scanning direction, M is a number of nozzles present in the distance between passes, C is a number of nozzles in one scan, D is a number of nozzles used in a total of scans, E is a number of nozzles physically usable from a configuration of the liquid discharge head, and F is a feed amount per scan calculated from the nozzles physically usable, the following relations are satisfied: C=F; and D≤E. An amplitude of a composite wave obtained by superimposing a first sine wave generated by rotation of the conveyance roller in formation of a first pass and a second sine wave generated by rotation of the conveyance roller in formation of a second pass is smaller than an amplitude of each of the first sine wave and the second sine wave.

BRIEF DESCRIPTION OF THE DRAWINGS

The aforementioned and other aspects, features, and advantages of the present disclosure would be better understood by reference to the following detailed description when considered in connection with the accompanying drawings, wherein:

FIG. 6 is a schematic diagram illustrating an example of a printing operation by a multi-pass method;

FIG. 7 is a diagram illustrating an example of scanning;

Figure 1:
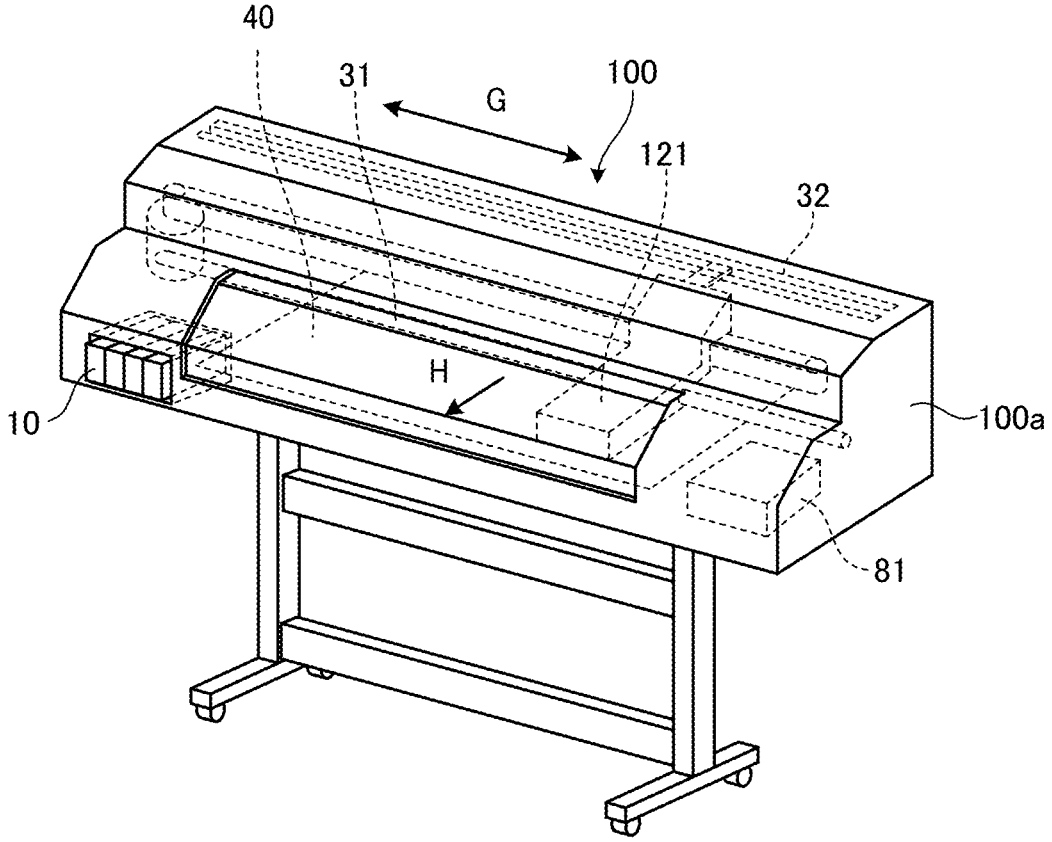
FIG. 1 is a perspective view of the inside of an image forming apparatus according to a first embodiment of the present disclosure.

The accompanying drawings are intended to depict embodiments of the present disclosure and should not be interpreted to limit the scope thereof. The accompanying drawings are not to be considered as drawn to scale unless explicitly noted.

DETAILED DESCRIPTION OF EMBODIMENTS

In describing embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner and achieve similar results.

Although the embodiments are described with technical limitations with reference to the attached drawings, such description is not intended to limit the scope of the disclosure and all of the components or elements described in the embodiments of this disclosure are not necessarily indispensable.

Referring now to the drawings, embodiments of the present disclosure are described below. In the drawings for explaining the following embodiments, the same reference codes are allocated to elements (members or components) having the same function or shape and redundant descriptions thereof are omitted below.

Hereinafter, a liquid discharge apparatus and an image forming method according to embodiments of the present disclosure are described in detail with reference to the accompanying drawings.

Hereinafter, an image forming apparatus is described as a liquid discharge apparatus according to an embodiment of the disclosure. However, embodiments of the present disclosure are not limited to the image forming apparatus. The technology according to an embodiment of the present disclosure is also applicable to liquid discharge apparatuses other than the image forming apparatus, such as a three-dimensional fabricating apparatus, a treatment-liquid applying apparatus, and a jet granulating apparatus.

A first embodiment according to the present embodiment is described below.

Figure 2:
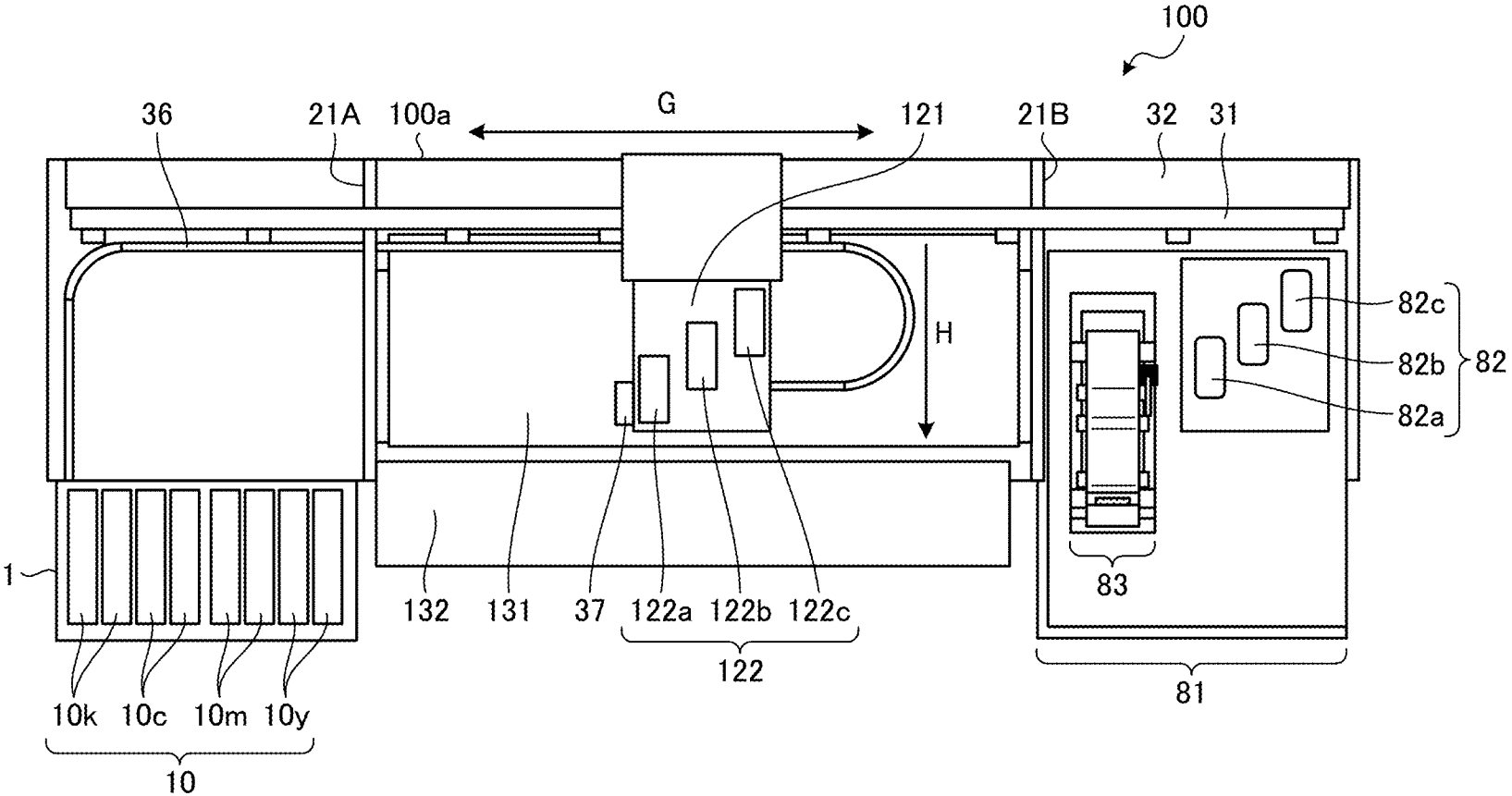
FIG. 2 is a schematic view of a configuration of the image forming apparatus according to the first embodiment of the present disclosure.

FIG. 1 is a perspective view of an image forming apparatus 100 according to the first embodiment, in which the inside thereof is illustrated in a see-through manner. FIG. 2 is a schematic diagram illustrating the configuration of the image forming apparatus 100. As illustrated in FIGS. 1 and 2, the image forming apparatus 100 according to the present embodiment is a wide serial-type inkjet recording apparatus.

As illustrated in FIGS. 1 and 2, the image forming apparatus 100 includes side plates 21A and 21B on the left and right sides of an apparatus body 100*a*. A main guide rod 31 serving as a guide member is horizontally bridged over the side plates 21A and 21B. The image forming apparatus 100 also includes a sub sheet-metal guide 32. The main guide rod 31 and the sub sheet-metal guide 32 slidably hold a carriage 121. The carriage 121 moves and scans in a direction indicated by arrow G (carriage main-scanning direction) via a timing belt rotationally driven by a main scanning motor 117 (see FIG. 3). An optical sensor 37 is mounted on the carriage 121 to detect an end (sheet end) of the medium 40.

The carriage 121 includes liquid discharge heads 122*a*, 122*b*, and 122*c*, which are collectively referred to as "liquid discharge heads 122" when not distinguished from one another. The liquid discharge heads 122*a*, 122*b*, and 122*c* serving as recording heads discharge ink droplets (liquid) of different colors such as yellow (Y), cyan (C), magenta (M), black (K), orange (O), green (G), and clear (Cl) according to ink cartridges 10 mounted on the image forming apparatus 100. Each of the liquid discharge heads 122 includes a plurality of nozzle rows. Each of the plurality of nozzle rows includes a plurality of nozzles 125 (see FIG. 5) aligned in a sub-scanning direction. Here, the sub-scanning direction (indicated by arrow H in FIGS. 1 and 2) is a direction orthogonal to the carriage main-scanning direction (indicated by arrow G in FIGS. 1 and 2). The liquid discharge head 122 is mounted on the carriage 121 such that the direction in which ink droplets are discharged from the nozzles 125 faces downward. The liquid discharge heads 122*a*, 122*b*, and 122*c* are disposed to be offset from each other in the sub-scanning direction. The carriage 121 is provided with sub-tanks for supplying ink of the colors to the liquid discharge heads 122.

The image forming apparatus 100 includes a cartridge loading unit 1 to which ink cartridges 10*y*, 10*c*, 10*m*, and 10*k* (referred to as "ink cartridges 10" when not distinguished) of different colors are detachably mounted. The inks in the ink cartridges 10 are replenished and supplied to the sub tanks of the carriage 121 via supply tubes 36 of respective colors by a supply pump unit. The ink cartridges 10 may include a white ink cartridge.

The image forming apparatus 100 includes a maintenance-and-recovery mechanism 81 in a non-printing area on one end in the main scanning direction of the carriage 121. The maintenance-and-recovery mechanism 81 maintains and recovers the conditions of the nozzles 125 of the liquid discharge head 122. The maintenance-and-recovery mechanism 81 includes cap members (hereinafter referred to as "caps") 82*a*, 82*b*, and 82*c* and a wiping unit 83. The caps 82*a*, 82*b*, and 82*c* (referred to as "caps 82" when not distinguished) cap the nozzle surfaces of the liquid discharge heads 122. The wiping unit 83 wipes the nozzle surfaces. A replaceable waste liquid tank that store waste liquid generated by the maintenance and recovery operation is disposed below the maintenance-and-recovery mechanism 81 of the liquid discharge head 122.

Figure 3:
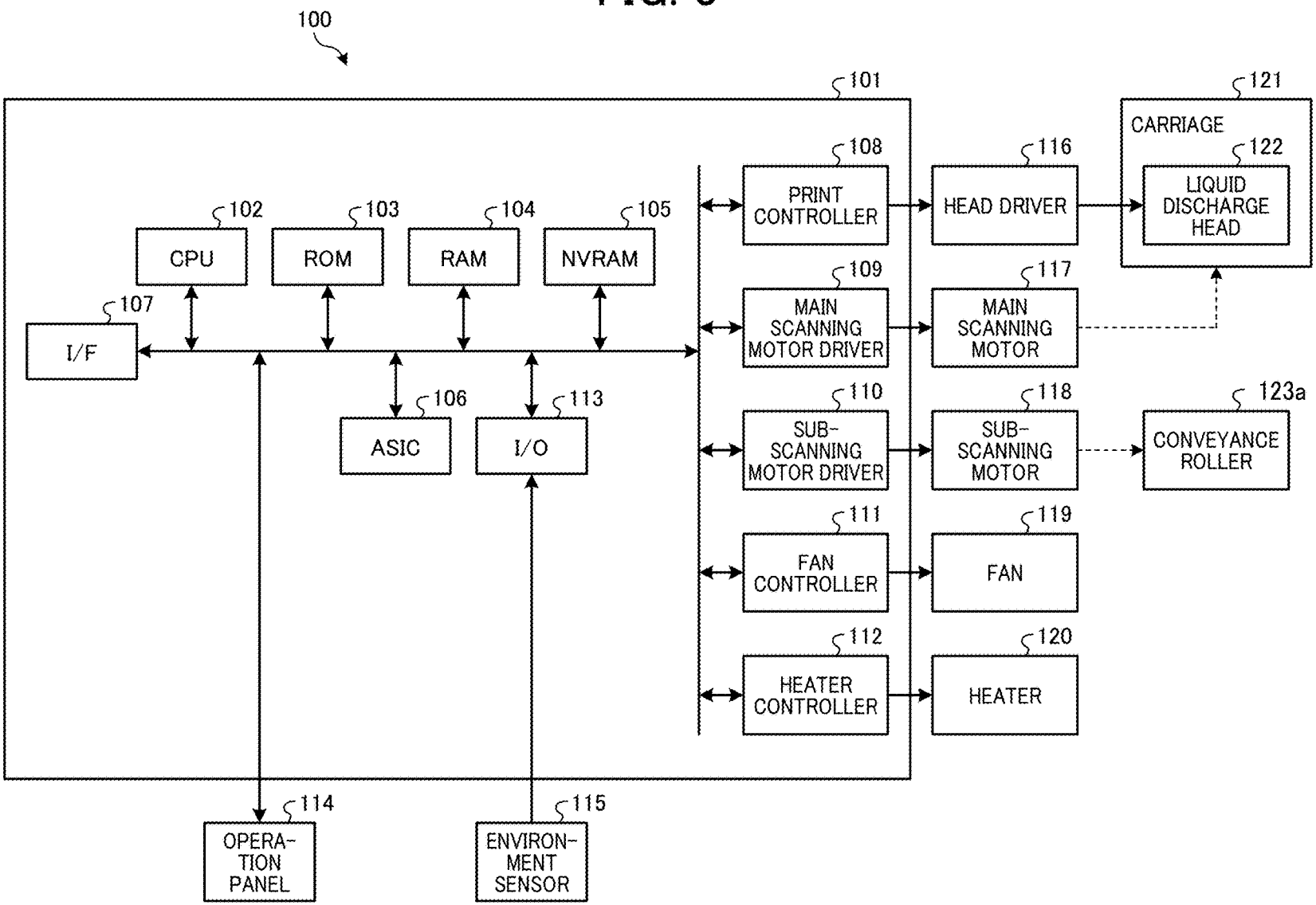
FIG. 3 is a block diagram illustrating an example of a hardware configuration of the image forming apparatus illustrated in FIG. 2.

FIG. 3 is a block diagram illustrating an example of a hardware configuration of the image forming apparatus 100 illustrated in FIG. 2. As illustrated in FIG. 3, the image forming apparatus 100 includes a control device 101, an operation panel 114, an environment sensor 115, a head driver 116, a main scanning motor 117, a sub-scanning motor 118, a fan 119, a heater unit 120, the carriage 121, and a conveyance roller 123*a*.

As illustrated in FIG. 3, the control device 101 includes a central processing unit (CPU) 102, a read only memory (ROM) 103, a random access memory (RAM) 104, a non-volatile random access memory (NVRAM) 105, an application specific integrated circuit (ASIC) 106, an interface (I/F) 107, a print controller 108, a main scanning motor driver 109, a sub-scanning motor driver 110, a fan controller 111, a heater controller 112, and an input-and-output unit (I/O) 113. The CPU 102, the ROM 103, the RAM 104, the NVRAM 105, the ASIC 106, the I/F 107, the print controller 108, the main scanning motor driver 109, the sub-scanning motor driver 110, the fan controller 111, the heater controller 112, and the I/O 113 are communicably connected to each other via, for example, a bus.

The CPU 102 controls operations of the entire image forming apparatus 100. To be specific, the CPU 102 execute programs stored in, for example, the ROM 103 to implement various functions. The ROM 103 stores programs to be executed by the CPU 102 and other fixed data. The RAM 104 temporarily stores image data and other data. The NVRAM 105 holds data even while the image forming apparatus 100 is powered off. The ASIC 106 is a circuit that performs image processing for performing various signal processing and rearrangement and other processing on input and output signals for controlling the entire image forming apparatus 100.

The I/F 107 is an interface circuit that transmits and receives signals to and from a host side. For example, the I/F 107 receives print data (image data) generated by a printer driver of a host machine such as an information processing apparatus, an image reading device, or an imaging device via a cable or a network. That is, the print data may be generated and output to the control device 101 by the printer driver on the host side.

The print controller 108 is a circuit that generates a drive waveform for driving the liquid discharge head 122 and outputs print data for selectively driving a pressure generator that generates pressure for causing the liquid discharge head 122 to discharge liquid (ink) from the nozzles 125 and various data accompanied with the print data to the head driver 116.

The main scanning motor driver 109 is a circuit that drives the main scanning motor 117. The sub-scanning motor driver 110 is a circuit that drives the sub-scanning motor 118. The fan controller 111 is a circuit that controls the output of the fan 119 so that air is blown at a predetermined temperature and air volume. The heater controller 112 is a circuit that controls the heater unit 120 to achieve a set temperature. The I/O 113 is a circuit that acquires information from the environment sensor 115 and extracts information necessary for controlling units of the image forming apparatus 100. The I/O 113 also receives detection signals from various sensors other than the environment sensor 115.

The operation panel 114 is a device for inputting and displaying various information on, for example, user designation of resolution. The operation panel 114 is connected to, for example, the CPU 102 via a bus of the control device 101 so as to communicate with each other. The environment sensor 115 is, for example, a sensor that detects an environmental temperature, environmental humidity, or the like. The environment sensor 115 is connected to the I/O 113 of the control device 101.

The head driver 116 is a circuit that selectively apply drive pulses constituting a drive waveform, which is transmitted from the print controller 108, to the pressure generator of the liquid discharge head 122 based on input image data (for example, dot pattern data), to drive the liquid discharge heads 122. The head driver 116 is connected to the print controller 108 of the control device 101. The discharge amount is controlled by, for example, controlling the amplitude of the drive waveform input to the pressure generator of the liquid discharge head 122. However, the discharge amount may be controlled using another method.

The main scanning motor 117 is a device that drives the timing belt to rotate and moves the carriage 121 with the liquid discharge head 122 in the main scanning direction (direction of arrow G). The main scanning motor 117 is connected to the main scanning motor driver 109 of the control device 101.

The sub-scanning motor 118 is a device that is driven to cause the conveyance roller 123*a* to convey the medium 40, which is an object to which liquid (ink) is discharged by the liquid discharge head 122, in the sub-scanning direction (indicated by arrow H in FIGS. 1 and 2). The sub-scanning motor 118 is connected to the sub-scanning motor driver 110 of the control device 101.

The fan 119 is a device that is driven to promote convection of air inside the image forming apparatus 100 and prevent the temperature of an upper portion of the image forming apparatus 100 from excessively rising due to retention of warmed air. The fan 119 is connected to the fan controller 111 of the control device 101.

Figure 4:
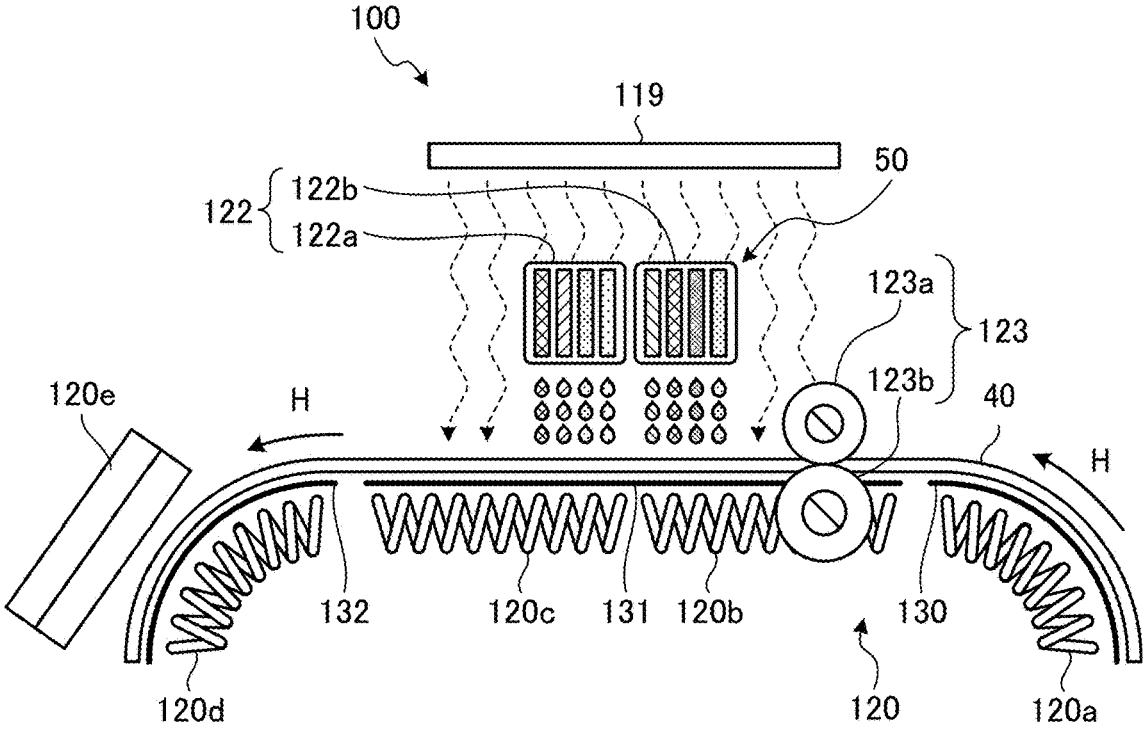
FIG. 4 is a diagram illustrating a schematic configuration of a heater illustrated in FIG. 3.

FIG. 4 is a schematic diagram illustrating the configuration of the heater unit 120 illustrated in FIG. 3. In the example illustrated in FIG. 4, for the sake of simplicity, two liquid discharge heads 122*a* and 122*b* are illustrated as representatives of the liquid discharge heads 122, and the description of the liquid discharge head 122*c* is omitted.

As illustrated in FIG. 4, the heater unit 120 includes a pre-heater 120*a*, a print heater 120*b*, a print heater 120*c*, a post-heater 120*d*, and a drying heater 120*e*. Each heater of the heater unit 120 is provided with a temperature sensor such as a thermistor for temperature control.

The pre-heater 120*a* is a device that preheats the medium 40 to a temperature suitable for forming a liquid application surface. For example, the pre-heater 120*a* (with an upper margin of +2° C. and a lower margin of 0° C.) is an aluminum-foil cord heater. The pre-heater 120*a* is attached to the back side of a conveyance guide plate 130. The pre-heater 120*a* warms the conveyance guide plate 130 itself to warm the medium 40.

As illustrated in FIG. 4, the medium 40 is set on the pre-heater 120*a* side. The medium 40 is intermittently conveyed by predetermined distances in the arrow H direction by a conveyance roller 123*a*, a driven roller 123*b*, and the like. Liquid is discharged from the liquid discharge heads 122 onto the medium 40 to form a liquid application surface of the medium 40. A driving force from the sub-scanning motor 118 is applied to the conveyance roller 123*a*, and the driven roller 123*b* that rotates following the conveyance roller 123*a*. When liquid is discharged from the liquid discharge heads 122, the conveyance roller 123*a* stops the conveyance of the medium 40. In other words, the control device 101 as a control unit controls the conveyance roller 123*a* and the liquid discharge heads 122 so that an operation of conveying the medium 40 in the sub-scanning direction by a predetermined distance by the conveyance roller 123*a* and stopping the medium 40 and an operation of discharging liquid from the nozzles 125 onto the medium 40 while scanning the liquid discharge head 122 in the main scanning direction orthogonal to the sub-scanning direction are alternately performed. Examples of media usable as the medium 40 include polyethylene terephthalate (PET), poly vinyl chloride (PVC), oriented polypropylene (OPP), and sheet-like media, which are called soft packaging media, in addition to roll-type paper.

In some embodiments, a configuration may be employed in which the positions of the conveyance roller 123*a* and the driven roller 123*b* illustrated in FIG. 4 are replaced with each other.

The medium 40 sent from the pre-heater 120*a* side is first preheated to a temperature suitable for forming a liquid application surface by the pre-heater 120*a*. The conveyance roller 123*a* and the driven roller 123*b* conveys the preheated medium 40 to an image forming unit 50 in which the liquid discharge heads 122 are disposed. The image forming unit 50, while keeping the medium 40 warm by the print heater 120*b* and the print heater 120*c*, discharges liquid such as ink from the liquid discharge heads 122 onto the medium 40 to form the liquid application surface.

The print heater 120*b* and the print heater 120*c* are devices that keep the medium 40 warm when a liquid application surface is formed on the medium 40. For example, the print heater 120*b* and the print heater 120*c* (with an upper margin of +0.5° C. and a lower margin of −0.5° C.) are cord heaters embedded in a platen 131 made of an aluminum material. The print heater 120*b* and the print heater 120*c* warm the platen 131 itself to warm the medium 40.

The warmed air rises together with the vapor. In order to prevent the temperature of the upper portion of the image forming apparatus 100 from rising excessively due to the retention of the warmed air, the fan 119 promotes convection of the air.

The post-heater 120*d* and the drying heater 120*e* are devices that warm the medium 40 on which the liquid application surface is formed in order to dry and fix liquid such as ink. For example, the post-heater 120*d* (with an upper margin of +2° C. and a lower margin of 0° C.) is an aluminum-foil cord heater. The post-heater 120*d* is attached to the back side of a conveyance guide plate 132. The post-heater 120*d* warms the conveyance guide plate 132 itself to warm the medium 40. For example, the drying heater 120*e* (with an upper margin of +0.5° C. and a lower margin of −0.5° C.) is an infrared (IR) heater. The drying heater 120*e* emits IR radiation to dry the liquid application surface of the medium 40. The drying heater 120*e* may be provided with a fan and configured to send hot air to the liquid application surface of the medium 40.

Figure 5:
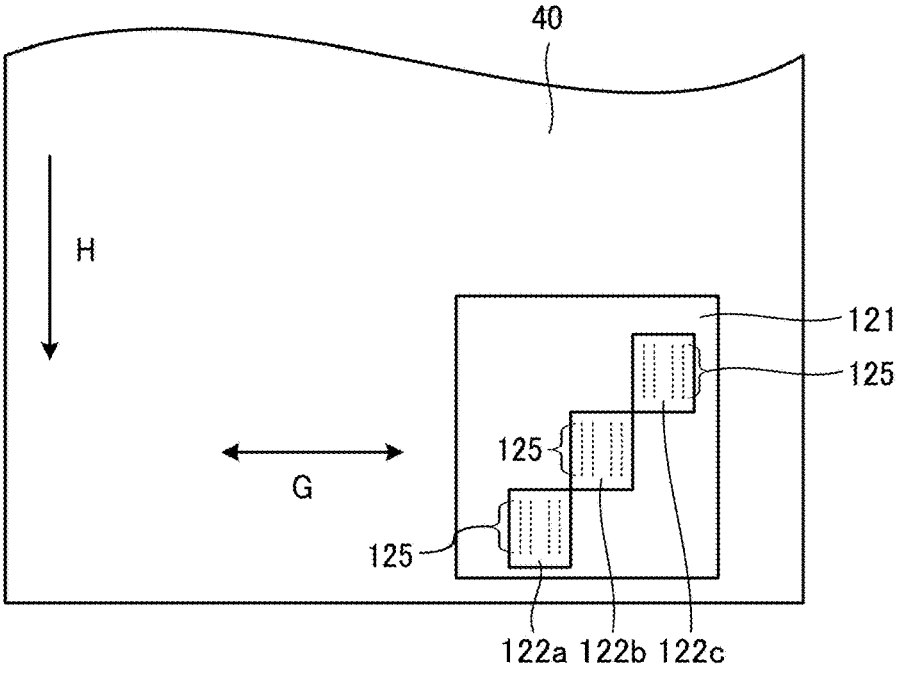
FIG. 5 is a schematic top view of a carriage illustrated in FIG. 3.

FIG. 5 is a schematic top view of the carriage 121 of FIG. 3. As illustrated in FIG. 5, the medium 40 is conveyed in the sub-scanning direction (conveyance direction) indicated by arrow H, and the carriage 121 scans in the direction perpendicular to the direction of movement of the medium 40 to form an image. In the formation of an image, the number of times of scanning is changed in accordance with the resolution of the image to be formed, thus allowing formation of a high-resolution image.

For example, if the drive frequency of the liquid discharge head 22 is increased with respect to the movement direction (main scanning direction) of the carriage 121 indicated by arrow G in FIG. 5 to discharge ink at a higher frequency, the resolution in the main scanning direction can be increased even at the same movement speed of the carriage 121.

As illustrated in FIG. 4, the medium 40 on which the liquid application surface is formed in the image forming unit 50 is further conveyed downstream.

The drying heater 120*e* performs preheating so that the filament temperature reaches a target temperature (in other words, so that the filament temperature reaches the wavelength of an electromagnetic wave to be output) before the medium 40 on which the liquid application surface is formed arrives. Thereafter, when the medium 40 on which the liquid application surface is formed arrives, the drying heater 120*e* is turned on in synchronization with the stop timing of the sub-scanning operation. The lighting timing can be changed according to the type of the medium 40 or the operation mode. The reason why the drying heater 120*e* is not turned on simultaneously with the release of the sleep mode is to prevent deterioration of the medium 40 due to unnecessary radiation heating.

The post-heater 120*d* and the drying heater 120*e* that sends hot air dry and fix liquid such as ink on the medium 40. The dried and fixed medium 40 is further wound in a roll shape on the downstream side.

The image forming apparatus 100 according to the present embodiment performs two-layer overlapping printing to form a first layer and then form a second layer on the first layer in an overlapping manner. More specifically, the control device 101 of the image forming apparatus 100 performs printing of the entire region specified by an original document in the printing of a first layer, moves the medium 40 in the direction opposite to the conveyance direction, and forms a second layer on the first layer from the same start position in an overlapping manner.

The control device 101 of the image forming apparatus 100 may continuously form the first layer and the second layer for each scan. The control device 101 of the image forming apparatus 100 may form the second layer after completing the first layer for each arbitrary area. Such over-coating is not limited to two layers, and a multilayer structure having two or more layers may be used.

For example, in the example illustrated in FIG. 5, process color inks of black (K), cyan (C), magenta (M), and yellow (Y) may be allocated to the liquid discharge head 122*a* and the liquid discharge head 122*c* with white ink allocated to the liquid discharge head 122*b*. Such a configuration allows printing to be performed in a layered manner in an order of "process color→white", "white→process color", or "process color→white→process color". In addition, for example, when the liquid discharge head 122*b* performs printing with white ink and then the liquid discharge head 122*c* performs printing with process colors, a color image can be printed on a medium having been undercoated with white ink.

FIG. 6 is a schematic diagram illustrating an example of a printing operation by a multi-pass method. In order to simplify the description, an example in which printing is performed by one liquid discharge head is illustrated. However, even when the number of liquid discharge heads increases, the basic principle does not change. Here, an example is illustrated in which the nozzle pitch of the nozzles 125 is 150 dpi and two-pass ⅙ interlace printing is performed.

As illustrated in FIG. 6, the two-pass ⅙ interlace printing requires two scans for printing in the main scanning direction and therefore is referred to as two pass. The two-pass ⅙ interlace printing requires six scans for printing in the sub-scanning direction. The interlace is a recording method in which a medium is fed by a feed amount smaller than the nozzle pitch in the sub-scanning direction, and can increase the substantial recording resolution by two to several times. Since the resolution in the sub-scanning direction is obtained by multiplying the nozzle pitch with the reciprocal of the interlace, the resolution in this case is 900 dpi. Further, since the total number of times of scanning until the printing operation is completed is obtained by multiplying the number of passes with the reciprocal of the interlace, the image is completed by the total number of times of scanning=2×6=12 times of scanning. In this case, as illustrated in FIG. 7, two cells are filled in the main scanning direction, six cells are filled in the sub-scanning direction, and 2×6=12 cells are filled in total. The dots denoted by 1 are formed during the first scan, and the dots denoted by 2, 3, 4, . . . are formed during the second, third, fourth, . . . scans, respectively. Here, dots denoted by 1 to 6 are formed in the first pass, and dots denoted by 7 to 12 are formed in the second pass.

Next, the periodic banding caused by the conveyance roller 123*a* is described.

Figure 8:
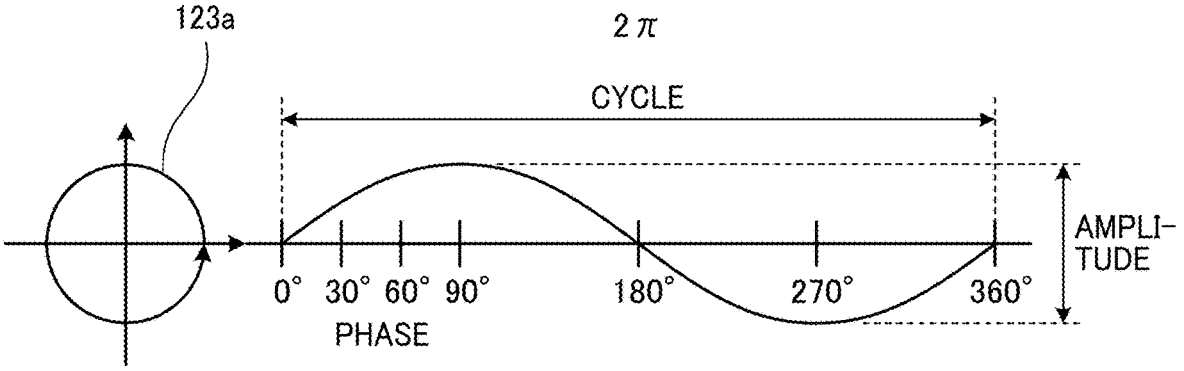
FIG. 8 is a diagram illustrating sine waves generated by rotation of a conveyance roller.

FIG. 8 is a diagram illustrating sine waves generated by rotation of the conveyance roller 123*a*. In FIG. 8, the horizontal axis represents the cycle, and the vertical axis represents the amplitudes generated by the rotation of the conveyance roller 123*a*. One cycle corresponds to one rotation ($2\pi$) of the conveyance roller 123*a*. Since the conveyance roller 123*a* actually conveys the medium 40 while rotating, this cycle is repeated. In the actual printing operation, the horizontal axis represents the distance at which the medium 40 is conveyed by the conveyance roller 123*a*, and the vertical axis represents the variation in feed amount of the medium 40 by the conveyance roller 123*a*. That is, when an ideal roller is assumed in which there is no eccentricity and the feed amount of the medium 40 by the rotation of the conveyance roller 123*a* is constant regardless of the rotation phase of the conveyance roller 123*a*, the vertical axis indicates the magnitude of variation in the feed amount of the medium 40 when compared with the ideal roller, which occurs during one actual rotation of the conveyance roller 123*a*.

Figure 9:
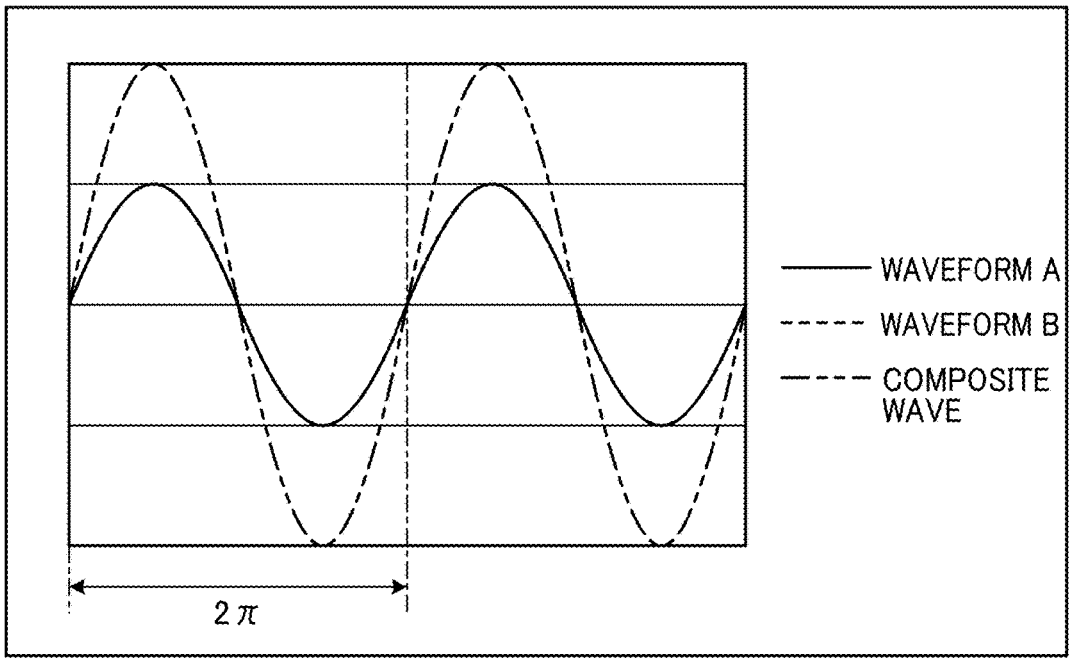
FIG. 9 is a diagram illustrating a waveform A of a sine wave corresponding to first-pass formation, a waveform B of a sine wave corresponding to second-pass formation, and a composite wave in which the waveform A and the waveform B overlap each other.

FIG. 9 is a diagram illustrating a waveform A of a sine wave corresponding to first-pass formation, a waveform B of a sine wave corresponding to second-pass formation, and a composite wave in which the waveform A and the waveform B overlap each other. Similar to the sine wave illustrated in FIG. 8, each waveform indicates the magnitude of the variation in the feed amount of the medium 40 when compared with the ideal roller, which occurs during one actual rotation of the conveyance roller 123*a*. In the example illustrated in FIG. 9, since sine waves having a phase difference of $2\pi$ have exactly the same phase, the waveform A and the waveform B overlap each other. Accordingly, the amplitude of the composite wave increases. The fact that the amplitudes of the sine waves generated by the conveyance roller 123*a* coincide with each other means that the deviation of the landing position from the target position of the ink caused by the variation in the feed amount of the medium 40 between the first-pass formation and the second-pass formation appears as a positional deviation in dots (for example, a dot 1 and a dot 7 illustrated in FIG. 7) at the same position in the main scanning direction. As a result, the landing position deviation of liquid droplets occurs continuously in the main scanning direction, and is more likely to be perceived as banding in the image on the medium 40. That is, the increase in the amplitudes of the sine waves generated by the conveyance roller 123*a* corresponds to the fact that continuous landing position deviations occur in the main scanning direction and banding is more likely to be perceived in the image on the medium 40.

Figure 10:
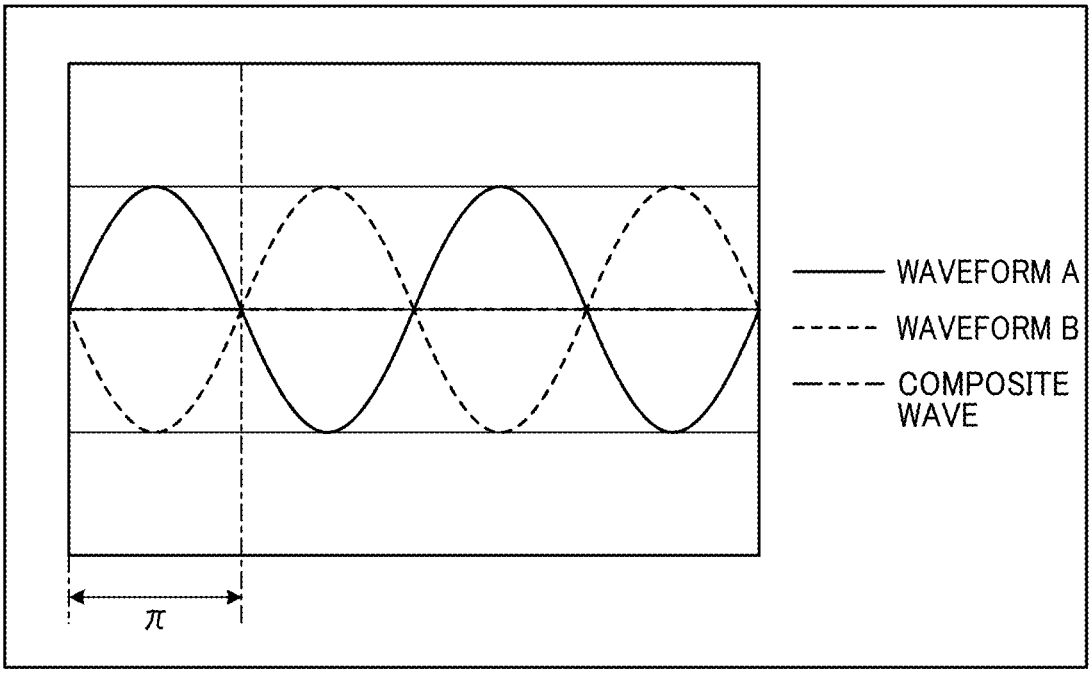
FIG. 10 is a diagram illustrating a case where the phases of the waveform A of the sine wave and the waveform B of the sine wave are shifted by π.

On the other hand, FIG. 10 is a diagram illustrating a case where the phases of the waveform A of the sine wave and the waveform B of the sine wave are shifted by π. Similar to the sine wave illustrated in FIG. 8, each waveform indicates the magnitude of variation in the feed amount when compared with the ideal roller, which occurs during one actual rotation of the conveyance roller 123*a*. In the example illustrated in FIG. 10, sine waves having a phase difference of π are completely opposite in phase, so that the composite waves cancel each other in amplitude. In this case, contrary to the example illustrated in FIG. 9, the feed variation of the medium 40 can be canceled, and thus the banding due to the feed variation of the medium 40 can be restrained.

The control device 101 as a control unit according to the present embodiment controls the movement of the liquid discharge heads 122 in the main scanning direction and the discharge of liquid by the liquid discharge heads 122 via the print controller 108 and the main scanning motor driver 109, and also controls the driving of the conveyance roller 123*a* via the sub-scanning motor driver 110.

The control device 101 controls the liquid discharge heads 122 to discharge liquid onto the medium X times (for example, twice in the example illustrated in FIGS. 6 and 7) in the main scanning direction and Y times (for example, six times in the example illustrated in FIGS. 6 and 7) in the sub-scanning direction for a total of X×Y times for each unit region corresponding to the nozzle pitch that is the pitch of the nozzles 125 in the sub-scanning direction. Here, X is an integer of two or more, and Y is an integer of two or more.

The control device 101 controls the conveyance roller 123*a* to convey the medium 40 such that the position of a liquid droplet on the medium discharged from a nozzle of the nozzles 125 by the m-th discharge (here, m is an integer not smaller than one and not greater than ((X−1)×Y)) and the position of another liquid droplet on the medium discharged from another nozzle of the nozzles 125 by the (m+Y)-th discharge are the same in the sub-scanning direction.

Here, the following relation is satisfied, where P is the circumferential length of the conveyance roller 123*a* and L is the difference between the conveyance distances of the medium 40 in the sub-scanning direction when the m-th discharge from the nozzles 125 is compared with the (m+Y)-th discharge from the nozzles 125.

$L=(n+(\Delta\theta/2\pi))\times P$ (where $\pi-\Delta\theta<60°$, and N is an integer).

Accordingly, the landing position deviation of liquid droplets is less likely to occur continuously in the main scanning direction in the unit region, and the landing position deviation of liquid droplets is less likely to be perceived as banding in the image on the medium 40. Thus, the periodical banding caused by the eccentricity of the conveyance roller 123*a* can be restrained.

A conveyance roller used for conveying a medium may be made of metal or rubber and slightly eccentric with respect to the center of rotation. When the conveyance roller conveys the medium, the conveyance amount may be shifted due to the eccentricity. The shift is represented by a periodic sine wave. When an image is completed by the multi-pass method, sine waves overlap and increase the shift. Thus, periodic banding may be significant.

However, according to the related art, although it is possible to bring the conveyance accuracy close to the target conveyance amount, it is not possible to take measures against the periodic phase shift due to the eccentricity of the conveyance roller. Although it is possible to reduce the eccentricity by increasing the processing accuracy of the conveyance roller, it is extremely difficult to completely eliminate the eccentricity, and increasing the processing accuracy involves an increase in cost.

In addition, in recent years, wide inkjet recording apparatuses have been increasingly used in the sign graphics market. As specific applications in the sign graphics market, there are signboards, advertisements, banners, hot flashes, and the like that are decorated indoors and outdoors. However, when the above-described banding occurs, image quality is significantly degraded. In particular, the periodic banding occurs over a wide range, and thus becomes conspicuous. For this reason, restraining banding is an important issue for ensuring image quality.

As described above, in the image forming apparatus 100 according to the present embodiment, the periodic banding due to the eccentricity of the conveyance roller 123*a* is restrained without increasing the cost for, for example, the enhancement of the processing accuracy of the conveyance roller 123*a*. This will be described in detail below.

Figure 11:
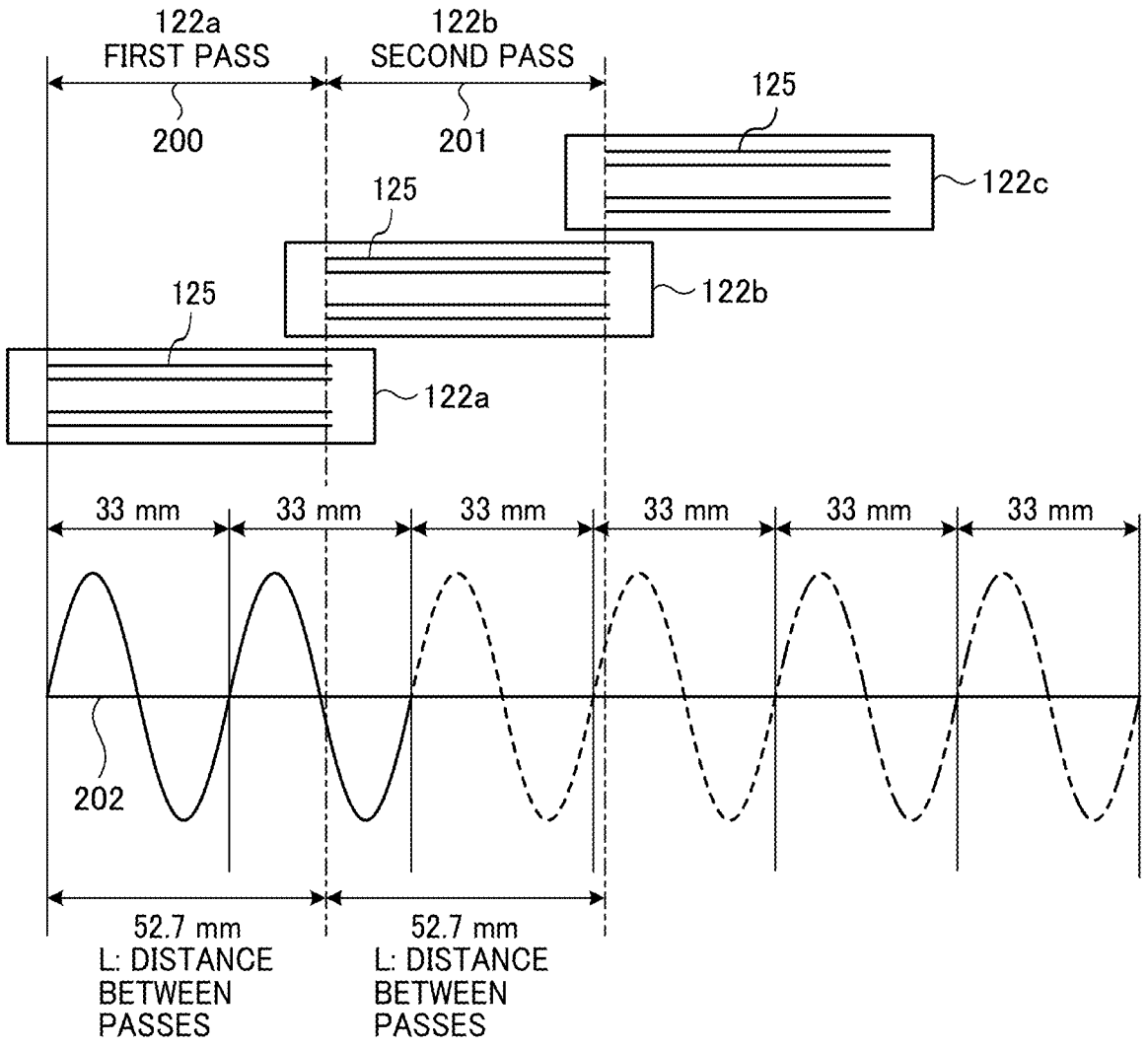
FIG. 11 is a diagram illustrating an example of liquid discharge heads.

FIG. 11 is a diagram illustrating an example of the liquid discharge heads 122*a*, 122*b*, and 122*c* serving as recording heads. In the example illustrated in FIG. 11, nozzles 125 of yellow (Y), cyan (C), magenta (M), and black (K) are arranged in the liquid discharge heads 122*a* and 122*b* of the three liquid discharge heads 122, and orange (O) and green (G) as special colors are arranged in the liquid discharge head 122*c*. The nozzle pitch of each liquid discharge head 122 used in this embodiment is 150 dpi (25.4/150=about 0.1693 mm). Each liquid discharge head 122 has four nozzle rows. Each of the nozzle rows of the liquid discharge head 122 includes 320 nozzles 125. The liquid discharge head 122*a* and the liquid discharge head 122*b* overlap each other in terms of ten nozzles 125 at end portions, which will be described later in detail.

As described above, since the printing operation in the present embodiment is performed by two pass and ⅙ interlace, an image is completed by twelve scans. The purpose of allocating orange and green to the liquid discharge head 122*c* is to enhance the color reproducibility. However, a color image output by the image forming apparatus 100, which is a wide serial-type inkjet recording apparatus, generally has a high usage ratio of CMYK. In the image forming apparatus 100 according to the present embodiment, for the purpose of enhancing the image quality of a normal color image, the relationship with the cycle of the conveyance roller 123*a* is examined blow in the case of performing multi-pass printing by twelve scans of the two liquid discharge heads 122*a* and 122*b* having the nozzles 125 for CMYK.

In the image forming apparatus 100 according to the present embodiment, among the liquid discharge heads 122 illustrated in FIG. 11, first-pass printing is performed in the liquid discharge head 122*a*, and second-pass printing is performed in the liquid discharge head 122*b*. The distance 200 of the first pass used for printing with the liquid discharge head 122*a* and the distance 201 of the second pass used for printing with the liquid discharge head 122*b* are the same, and are hereinafter referred to as the distance L between passes.

Next, an example is described in which M represents the number of nozzles 125 present between passes, C represents the number of nozzles 125 in one band (scan), D represents the number of nozzles 125 to be used, and the feed amount (number F of nozzles) per scan calculated from the nozzles to be used is calculated.

When the number of nozzles present at the distance L between passes is defined as M.

M=L/nozzle pitch=L/0.1693. Since the number of times of scanning at the distance L between passes is the reciprocal of the interlace, the number C of nozzles in one band (scan) is calculated as follow.

C=M/(reciprocal of interlace). In addition, when the number of nozzles used in a total of 12 times of scans is defined as D, D=C×number of scans.

Figure 12:
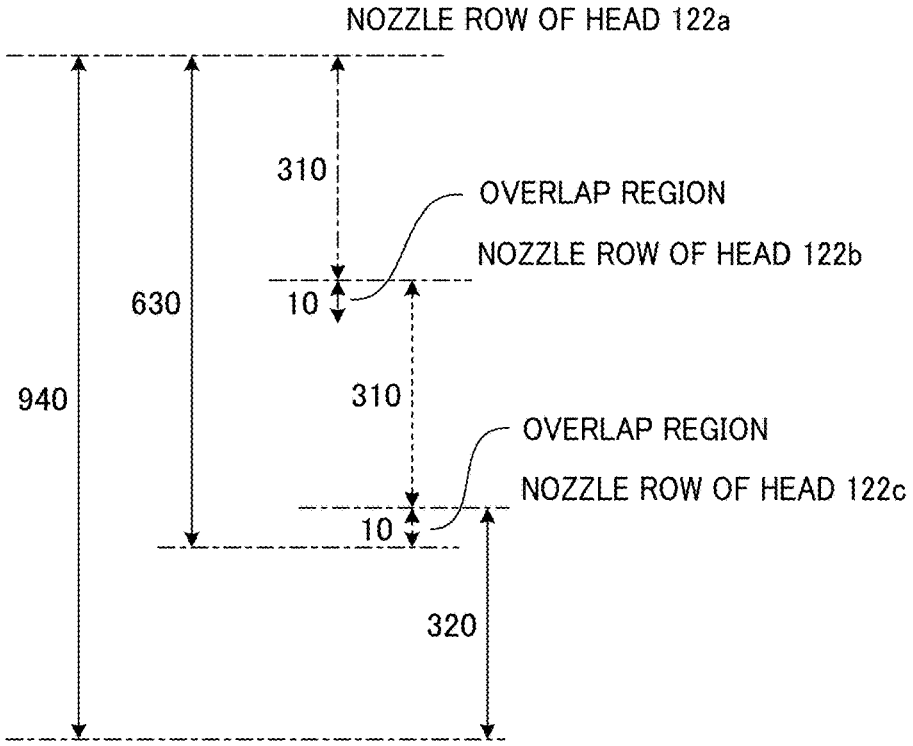
FIG. 12 is a diagram schematically illustrating the number of usable nozzles.

As described above, the liquid discharge head 122*a* and the liquid discharge head 122*b* physically overlap with respect to ten nozzles 125 at an end portion of each of the liquid discharge head 122*a* and the liquid discharge head 122*b*. FIG. 12 is a diagram schematically illustrating the number of usable nozzles. As illustrated in FIG. 12, if the liquid discharge heads 122 include two liquid discharge heads, i.e., the liquid discharge head 122*a* and the liquid discharge head 122*b*, the number E of physically usable nozzles 125 is 630. When the liquid discharge head 122 includes three liquid discharge heads 122*a*, 122*b*, and 122*c*, the number E of physically usable nozzles 125 is 940. The feed amount (the number F of nozzles) for each scan is calculated by a calculation formula in which the reciprocal of the interlace is taken into consideration for the value obtained by dividing the number E of physically usable nozzles 125 by the number of times of scanning. Although the detailed contents of the calculation formula are omitted here, F=51.8.

In the overlap region of the liquid discharge head 122, overlap processing may be performed in which a mask pattern is used to expand the overlap region and image data is exclusively allocated (distributed) to preceding and following scans (preceding scan and subsequent scan). In such a case, it is necessary to consider the number E of usable nozzles, but the other calculation methods may be performed in a similar manner.

In the image forming apparatus 100 according to the present embodiment, the following two conditions are satisfied as conditions established as a printing system.

(Condition 1) If the calculated number D of nozzles exceeds the number E of usable nozzles, the configuration of the liquid discharge head is not established, and thus D≤E is satisfied.

(Condition 2) The number C of nozzles in one band (scan) is equal to the feed amount (the number F of nozzles) per scan calculated from the actually used nozzles.

As an example satisfying the above-described conditions, in the case where the distance L between passes=52.7 and the number E of usable nozzles=630, C is 51.8, which coincides with F. In this case, the periodic phase of the conveyance roller 123*a* corresponding to the head position is as indicated by a reference numeral 202 in FIG. 11.

As described above, in the image forming apparatus 100 according to the present embodiment, printing in the first pass is performed in a region corresponding to the distance 200 of the first pass of the liquid discharge head 122*a* positioned on the upstream side, and printing in the second pass is performed in a region corresponding to the distance 201 of the second pass of the liquid discharge head 122*b* positioned at the center. Since the cycle of the conveyance roller 123*a* corresponds to the distance of 33 mm, the phase of the conveyance roller 123*a* in the first pass and the cycle of the sine wave by the conveyance roller 123*a* in the second pass are in a substantially-inverted phase relationship.

Figure 13:
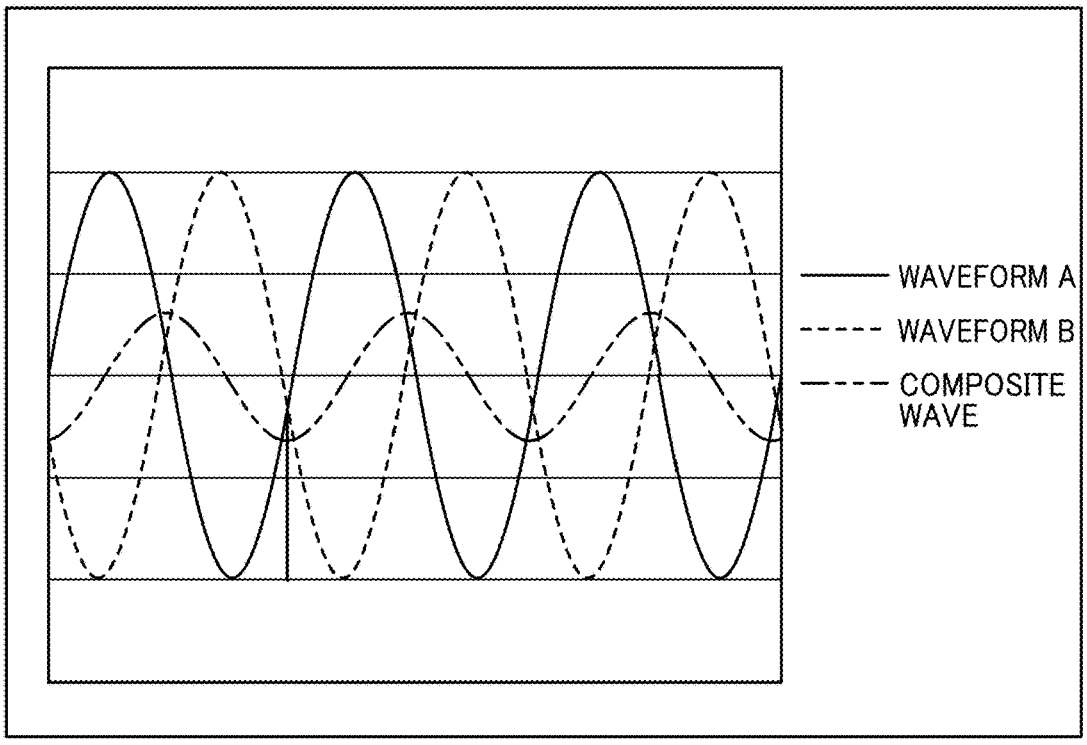
FIG. 13 is a diagram illustrating a waveform A of a sine wave corresponding to first-pass formation, a waveform B of a sine wave corresponding to second-pass formation, and a composite wave in which the waveform A and the waveform B overlap each other, according to the first embodiment of the present disclosure.

FIG. 13 is a diagram illustrating a waveform A of a sine wave corresponding to first-pass formation, a waveform B of a sine wave corresponding to second-pass formation, and a composite wave in which the waveform A and the waveform B overlap each other, according to the first embodiment. Similar to the sine wave illustrated in FIG. 8, each waveform indicates the magnitude of variation in the feed amount when compared with the ideal roller, which occurs during one actual rotation of the conveyance roller 123*a*. As illustrated in FIG. 13, when the sine wave A corresponding to the time of first-pass formation and the sine wave B corresponding to the time of second-pass formation are superimposed one on another, it can be seen that the amplitude of the composite wave decreases. Note that a method of setting the cycle of the phase to a completely opposite phase (phase difference it) will be described later in the following third embodiment.

As described above, according to the present embodiment, the feed amount F for each scan calculated from the nozzles in use coincides with the number of nozzles in one band (scan) calculated from the distance between passes, and the calculated number D of nozzles is equal to or less than the number E of usable nozzles. Therefore, the condition in which the printing system is established is satisfied. Since the sine wave generated by the rotation of the conveyance roller has a phase difference of about a half cycle for each pass, the amplitude of the composite wave of the sine waves in formation of each pass can be reduced. Such a configuration can restrain the periodic banding due to the variation in the feeding amount of the medium caused by the eccentricity of the conveyance roller without increasing the cost for, for example, enhancing the processing accuracy of the conveyance roller in production, thus ensuring the image quality.

Further, according to the present embodiment, the amplitude of the composite wave obtained by superimposing the sine wave generated by the rotation of the conveyance roller during image formation in the multi-pass method and the sine wave generated by the rotation of the conveyance roller during image formation in the next pass is smaller than the amplitude of each of the original sine waves. Such a configuration can restrain the periodic banding due to the variation in the feeding amount of the medium caused by the eccentricity of the conveyance roller without increasing the cost for, for example, enhancing the processing accuracy of the conveyance roller in production, thus ensuring the image quality.

In the present embodiment, the case where the number of times of scanning is twelve is taken as an example. However, the case where the number of times of scanning is changeable as in a high-order mode is also effective. For example, when the number of times of scanning is 16 (two pass and ⅛ interlace), the feed amount per scanning (the number F of nozzles) calculated from the actually used nozzles is 38.9. In this case, M=52.7/0.1693=311 and C=311/8=38.9, which satisfy the conditions.

Note that in the present embodiment, examples of orange and green are illustrated as special colors of the liquid discharge head 122*c*. Alternatively, white, clear, light cyan, light magenta, and the like may also be used as other special color inks.

Next, a description is given of a second embodiment of the present disclosure.

The second embodiment is different from the first embodiment in that $|\pi-\Delta\theta|\leq 60°$ is satisfied when there is a phase difference $\Delta\theta$ between sine waves generated by a conveyance roller in image formation of each pass in a multi-pass method. In the following description of the second embodiment, descriptions of the same parts as those in the first embodiment may be omitted, and differences from the first embodiment are mainly described.

Figure 14:
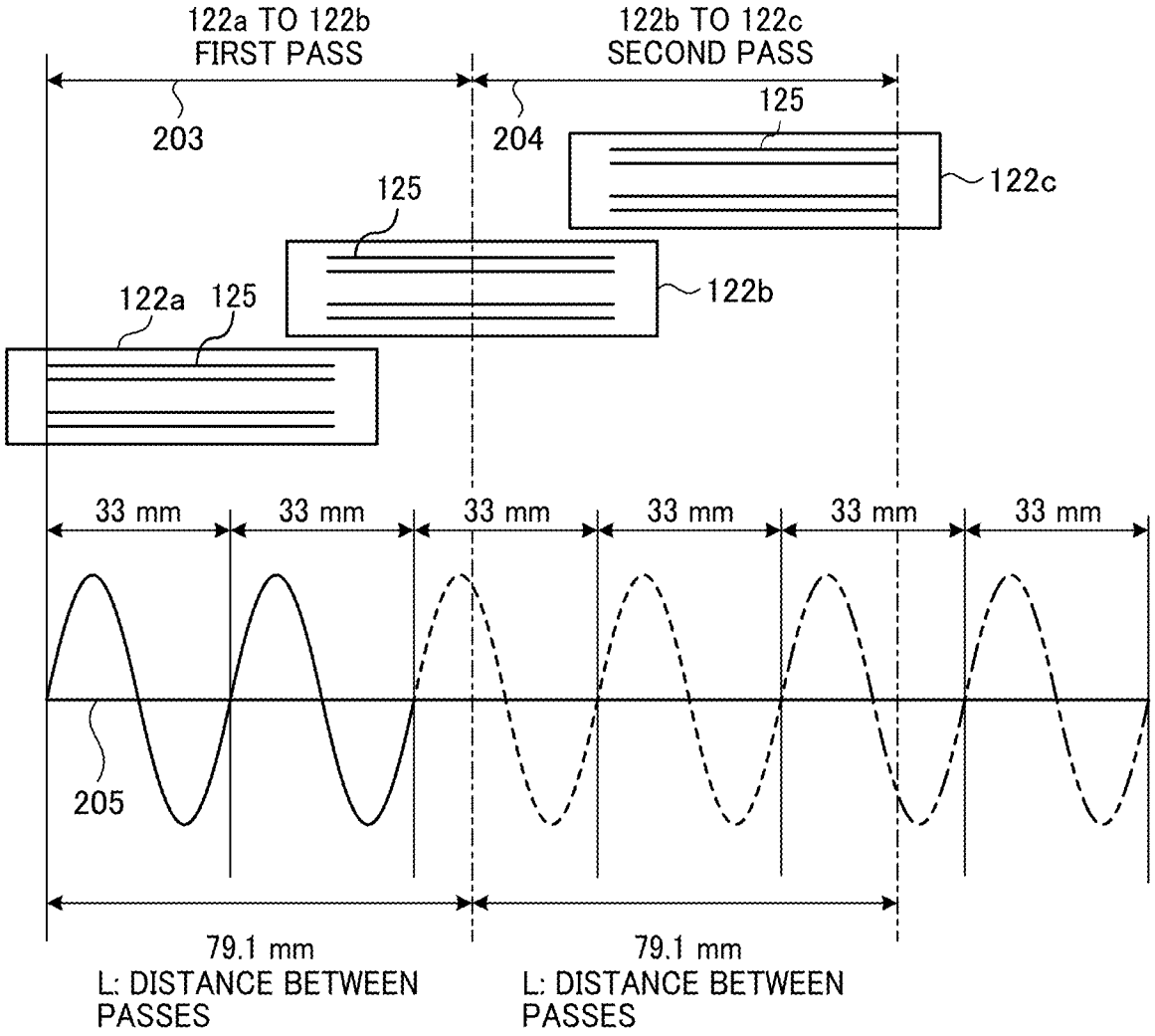
FIG. 14 is a diagram illustrating an example of liquid discharge heads according to a second embodiment of the present disclosure.

FIG. 14 is a diagram illustrating an example of liquid discharge heads according to the second embodiment of the present disclosure. As illustrated in FIG. 14, in the second embodiment, a liquid discharge head 122*a*, a liquid discharge head 122*b*, and a liquid discharge head 122*c* are provided. Nozzles 125 for CMYK are arranged in the liquid discharge head 122*a*, the liquid discharge head 122*b*, and the liquid discharge head 122*c* (collectively referred to as liquid discharge heads 122 unless distinguished).

The nozzle pitch of each liquid discharge head 122 used in this embodiment is 150 dpi (25.4/150=about 0.1693 mm). Each liquid discharge head 122 has four nozzle rows. The second embodiment is the same as the first embodiment in that the number of nozzles 125 in each of the nozzle rows of the liquid discharge head 122 is 320. In the second embodiment, as illustrated in FIG. 12, adjacent liquid discharge heads 122 overlap with each other in terms of ten nozzles 125 at end portions. Accordingly, in such a case, the number E of physically available nozzles is 940.

In the image forming apparatus 100 according to the present embodiment, printing in the first pass is performed using a region 203 including the liquid discharge head 122*a* positioned on the upstream side and the upper half of the liquid discharge head 122*b* positioned at the center. In the image forming apparatus 100 according to the present embodiment, printing in the second pass is performed using a region 204 including the lower half of the liquid discharge head 122*b* and the liquid discharge head 122*c* positioned on the downstream side.

As in the first embodiment, assuming that L represents the distance between passes, the number of times of scanning=the number of passes×the reciprocal of interlace, so that the number M of nozzles in the distance L between passes is obtained by L/0.1693, the number C of nozzles in one band is obtained by M/interlace, and the number D of nozzles used in a total of twelve scans is obtained by C×the number of scans.

As in the first embodiment, the number C of nozzles is equal to the feed amount (the number F of nozzles), and it is necessary to satisfy the relation of $D\leq E$. The distance L between the first pass and the second pass is calculated from L=C×interlace×0.1693.

When L=79.1, the number C of nozzles in one band (scan) and the feed amount (the number F of nozzles) per scan are equal to 77.8, and the number D of nozzles used in a total of twelve scans is 934, which satisfy the conditions to be established. The periodic phase of the conveyance roller 123 corresponding to the head position in this case is as indicated by a reference numeral 205 illustrated in FIG. 14.

Figure 15:
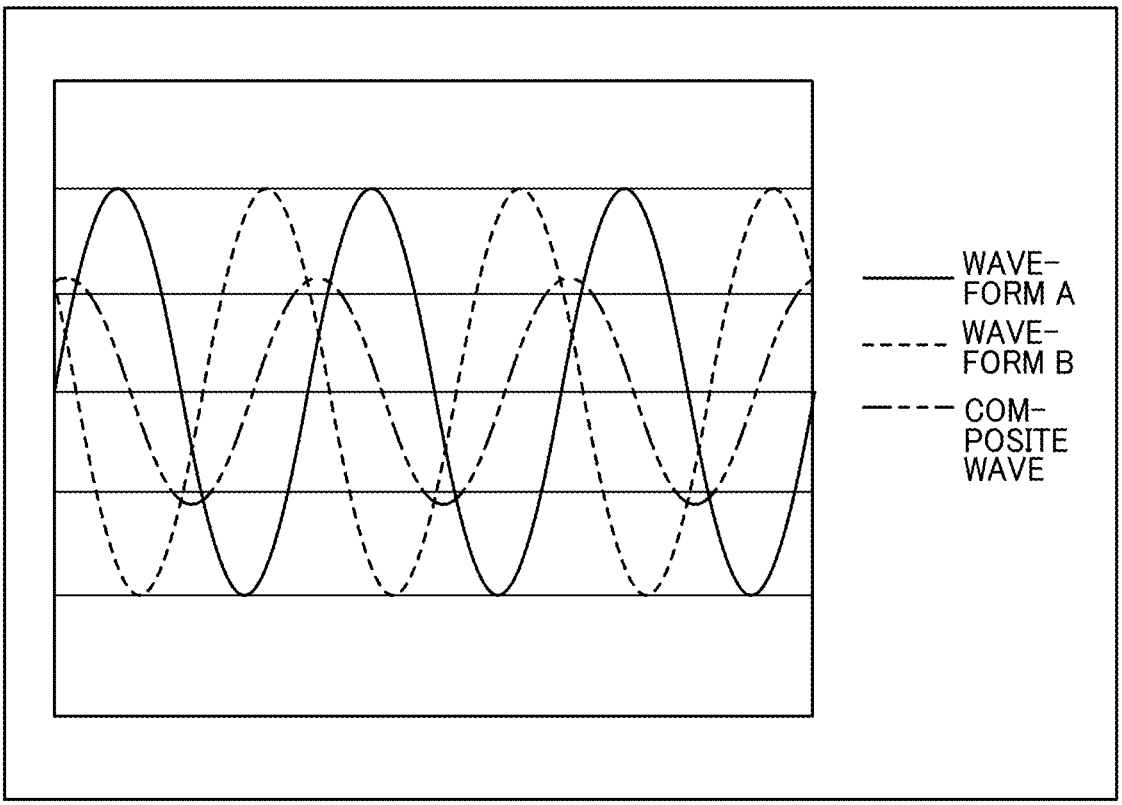
FIG. 15 is a diagram illustrating a waveform A of a sine wave corresponding to first-pass formation, a waveform B of a sine wave corresponding to second-pass formation, and a composite wave in which the waveform A and the waveform B overlap each other, according to the second embodiment of the present disclosure.

FIG. 15 is a diagram illustrating a waveform A of a sine wave corresponding to first-pass formation, a waveform B of a sine wave corresponding to second-pass formation, and a composite wave in which the waveform A and the waveform B overlap each other, according to the second embodiment. Similar to the sine wave illustrated in FIG. 8, each waveform indicates the magnitude of variation in the feed amount when compared with the ideal roller, which occurs during one actual rotation of the conveyance roller 123*a*. The same applies to FIGS. 16A, 16B, and 16C and FIGS. 17A, 17B, and 17C. As illustrated in FIG. 15, when the sine wave A corresponding to first-pass formation and the sine wave B corresponding to second-pass formation are superimposed one on another, the amplitude of the composite wave decreases. However, the amplitude is larger than that of the composite wave illustrated in FIG. 13.

Figure 16A:
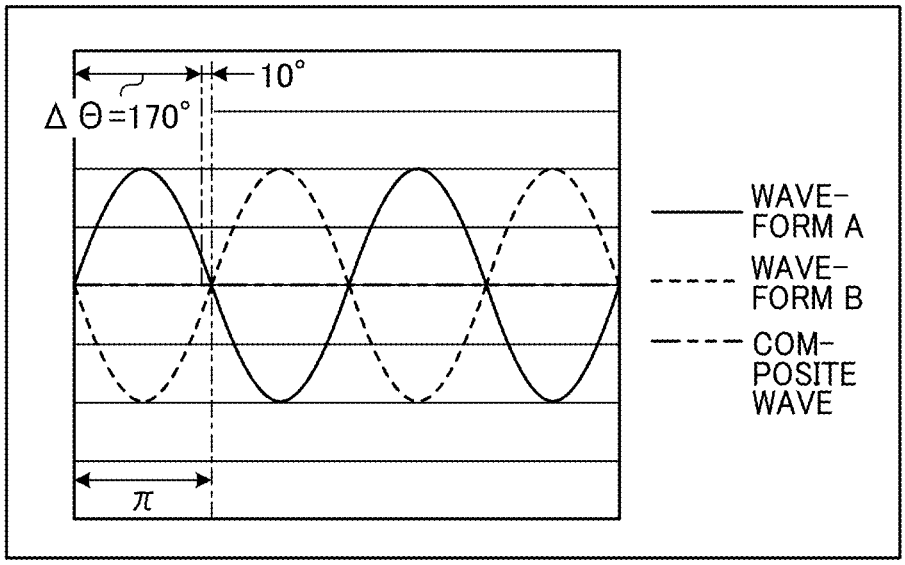
FIGS. 16A, 16B, and 16C are diagrams illustrating a composite wave in the case where the phase difference of a waveform B is changed in a direction of decreasing from π.
Figure 16B:
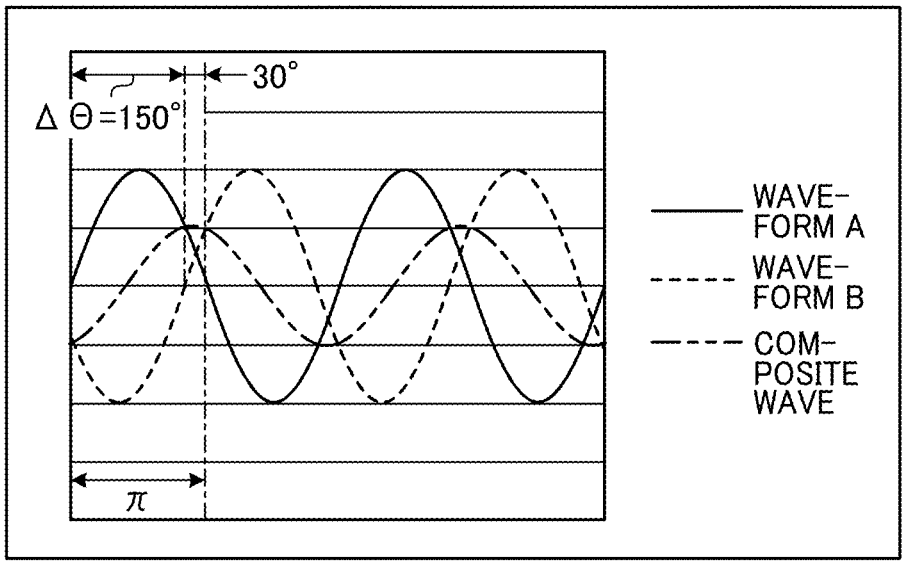
Figure 16C:
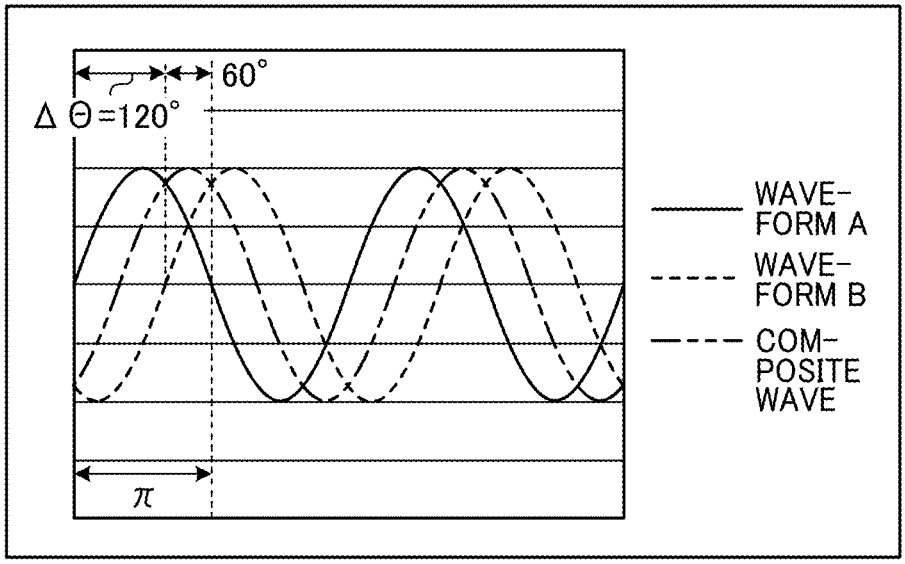
Figure 17A:
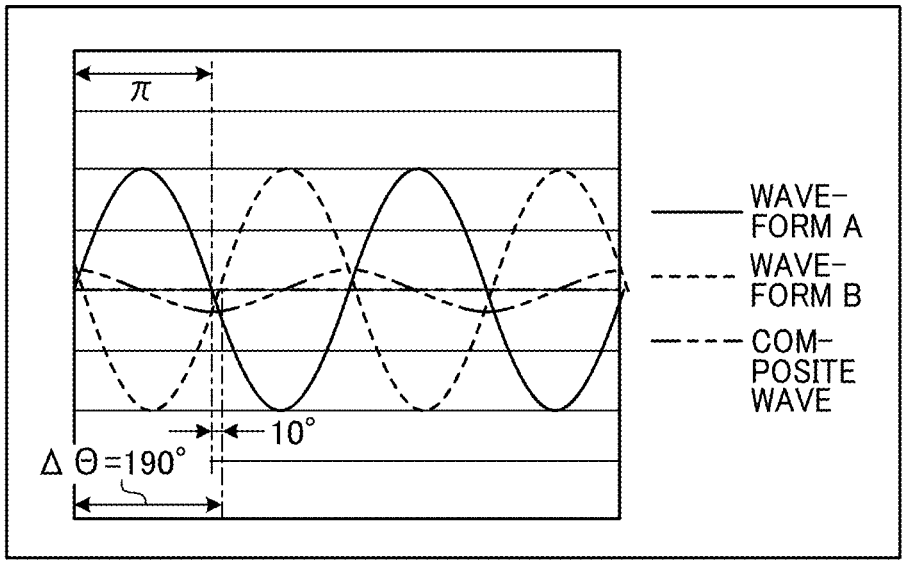
FIGS. 17A, 17B, and 17C are diagrams illustrating a composite wave in the case where the phase difference of a waveform B is changed in a direction of increasing from π.
Figure 17B:
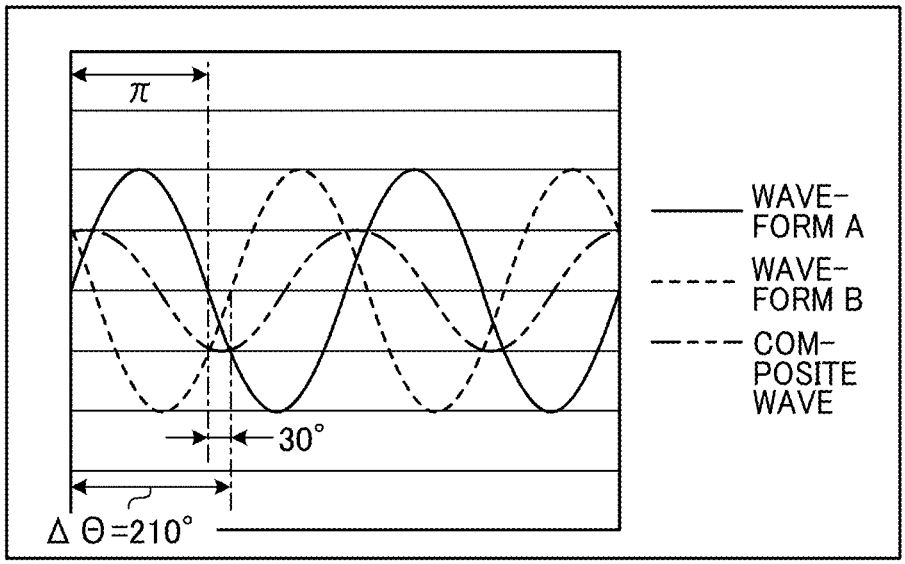
Figure 17C:
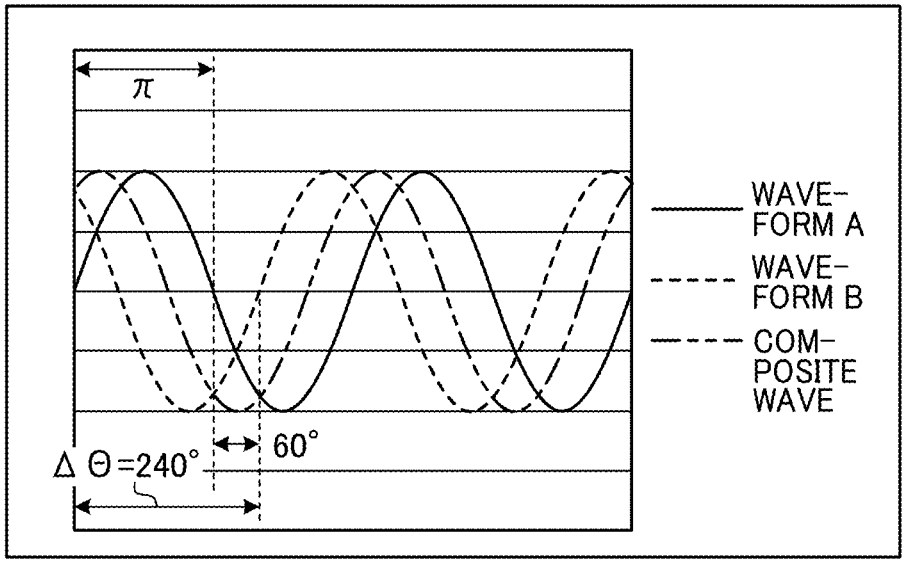

As illustrated in FIG. 10, the phase difference need be set to $\pi$ in order for the waveform of the sine wave to have an opposite phase. Here, FIGS. 16A, 16B, and 16C are diagrams illustrating a composite wave in the case where the phase difference of the waveform B is changed in a direction of decreasing from $\pi$. FIGS. 17A, 17B, and 17C are diagrams illustrating a composite wave in the case where the phase difference of the waveform B is changed in a direction of increasing from $\pi$. In FIGS. 16A, 16B, and 16C, the phase differences between the waveform A and the waveform B are reduced by 10°, 30°, and 60°, respectively, from $\pi$. Therefore, the phase differences in FIGS. 16A, 16B, and 16C are 170°, 150°, and 120°, respectively. On the other hand, FIGS. 17A, 17B, and 17C illustrate a composite wave in the case where the phase difference of the waveform B is changed from $\pi$ in the direction of increasing the phase difference. In FIGS. 17A, 17B, and 17C, the phase differences between the waveform A and the waveform B are increased by 10°, 30°, and 60° from $\pi$, respectively. Therefore, the phase differences in FIGS. 17A, 17B, and 17C are 190°, 210°, and 240°, respectively.

In each of FIGS. 16A, 16B, and 16C and FIGS. 17A, 17B, and 17C, even if there is a phase difference between the waveform A and the waveform B, the composite wave is merely inverted and the magnitude of the amplitude does not change in the case where the absolute value of |$\pi$−phase difference| is the same. Accordingly, when the absolute value of |$\pi$−phase difference| is reduced, the amplitude of the composite wave can be restrained. For example, if the absolute value of |$\pi$−phase difference| is less than 60°, the amplitude of the composite wave does not exceed the amplitude of the original sine wave. If the absolute value of |$\pi$−phase difference| is 30° or less, the amplitude of the composite wave is not greater than half of the amplitude of the original sine wave. For this reason, the sine wave in the first-pass formation and the sine wave in the second-pass formation are set so that the absolute value of |$\pi$−phase difference| is less than 60°, preferably 30° or less.

The control device 101 serving as the control unit according to the present embodiment controls the liquid discharge heads 122 to discharge liquid onto the medium 40 X times (for example, twice in the example illustrated in FIGS. 6 and 7) in the main scanning direction and Y times (for example, six times in the example illustrated in FIGS. 6 and 7) in the sub-scanning direction for a total of X×Y times for each unit region corresponding to the nozzle pitch that is the pitch of the nozzles 125 in the sub-scanning direction. Here, X is an integer of two or more, and Y is an integer of two two or more.

The control device 101 controls the conveyance roller 123*a* to convey the medium 40 such that the position of a liquid droplet on the medium discharged from a nozzle of the nozzles 125 by the m-th discharge (here, m is an integer not smaller than one and not greater than ((X−1)×Y)) and the position of another liquid droplet on the medium discharged from another nozzle of the nozzles 125 by the (m+Y)-th discharge are the same in the sub-scanning direction.

Here, the following relation is satisfied, where P is the circumferential length of the conveyance roller 123*a* and L is the difference between the conveyance distances of the medium 40 in the sub-scanning direction when the m-th discharge from the nozzles 125 is compared with the (m+Y)-th discharge from the nozzles 125.

$L=(n+(\Delta\theta/2\pi))\times P$ (where $\pi-\Delta\eta<60°$. N is an integer).

Accordingly, the landing position deviation of liquid droplets is less likely to occur continuously in the main scanning direction in the unit region, and the landing position deviation of liquid droplets is less likely to be perceived as banding in the image on the medium 40. Thus, the periodical banding caused by the eccentricity of the conveyance roller 123*a* can be restrained.

As described above, according to the present embodiment, when there is a phase difference of $\Delta\theta$ between sine waves generated by the conveyance roller in image formation in each pass in the multi-pass method, the relation of $|\pi-\Delta\theta|\leq 60°$ is set to be satisfied. Since the amplitude of the composite wave does not exceed the amplitude of the original sine wave, banding due to variations in the feed amount of the medium can be restrained.

Next, a description is given of a third embodiment of the present disclosure.

The third embodiment is different from the first embodiment and the second embodiment in that the circumferential length of the conveyance roller is optimized to have a completely opposite phase (phase difference $\Delta\theta=\pi$). In the following description of the second embodiment, descriptions of the same parts as those in the first embodiment and the second embodiment may be omitted, and differences from the first embodiment and the second embodiment are mainly described.

In the first embodiment and the second embodiment, when the circumferential length of the conveyance roller is determined, the distance L between passes is set so that the number C of nozzles in one band and the feed amount (the number F of nozzles) coincide with each other. However, as described above, the phase of the first pass of the conveyance roller and the sine wave of the second pass are not completely opposite to each other.

Therefore, in the third embodiment, the circumferential length of the conveyance roller is optimized to have a completely opposite phase (phase difference $\Delta\theta=\pi$).

Figure 18:
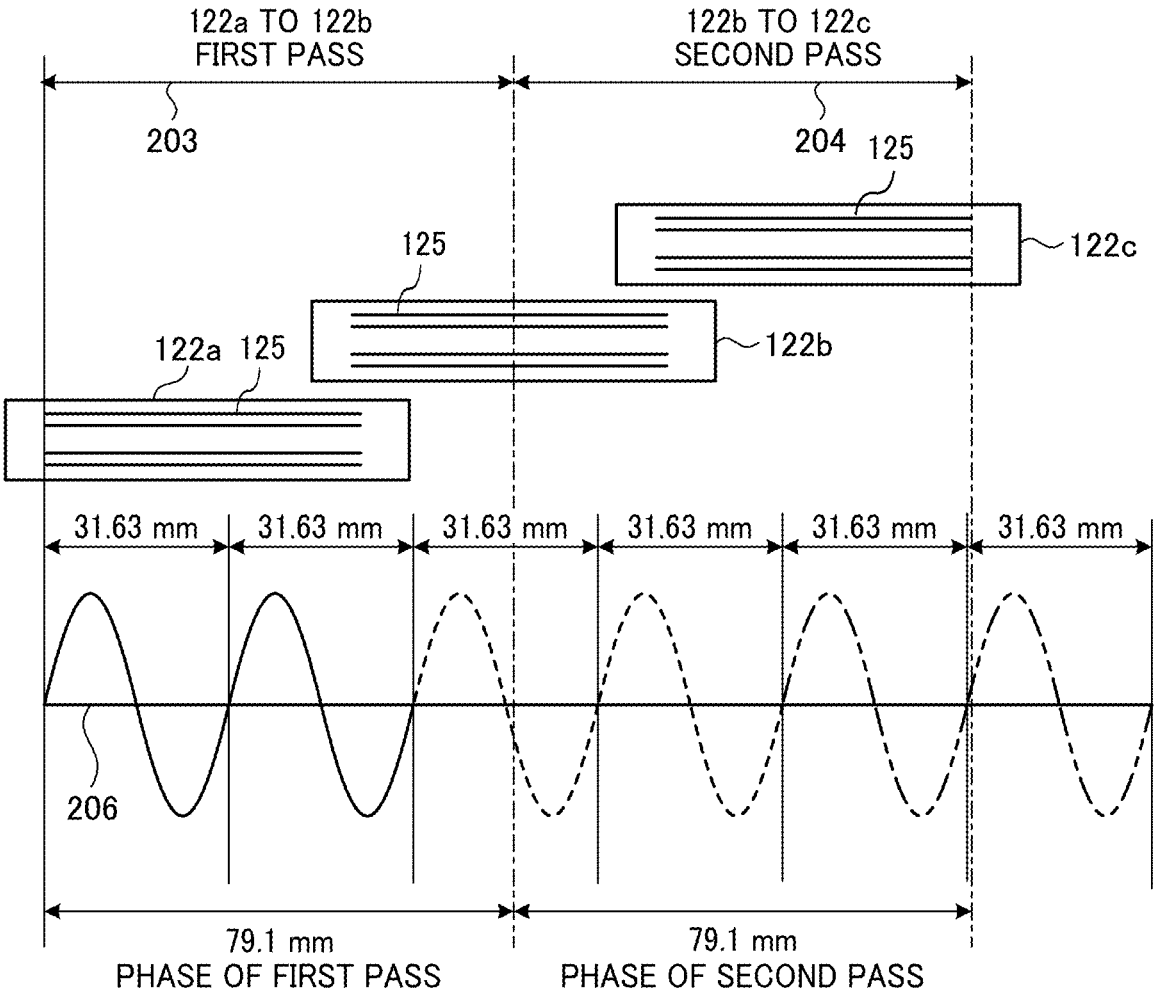
FIG. 18 is a diagram illustrating an example of liquid discharge heads according to a third embodiment of the present disclosure.

FIG. 18 is a diagram illustrating an example of liquid discharge heads according to the third embodiment of the present disclosure. As illustrated in FIG. 18, in the third embodiment, three liquid discharge heads 122*a*, 122*b*, and 122*c* are provided. Similarly to the second embodiment, nozzles 125 for CMYK are arranged in the liquid discharge head 122*a*, the liquid discharge head 122*b*, and the liquid discharge head 122*c* (collectively referred to as liquid discharge heads 122 unless distinguished).

The nozzle pitch of each liquid discharge head 122 used in this embodiment is 150 dpi (25.4/150=about 0.1693 mm). Each liquid discharge head 122 has four nozzle rows.

The third embodiment is the same as the second embodiment in that the number of nozzles 125 in each of the nozzle rows of the liquid discharge head 122 is 320. Since printing is performed with two pass and the reciprocal of the interlace is 6, an image is completed by twelve times of scanning, which is the same as the second embodiment. Adjacent liquid discharge heads 122 overlap with each other with respect to ten nozzles 125 at end portions overlap, which is the same as that illustrated in FIG. 12.

In the image forming apparatus 100 according to the present embodiment, the feed amount (the number F of nozzles)=77.8 and the reciprocal of the interlace is 6. Therefore, the number M of nozzles present at the distance between the first pass and the second pass is obtained by the following equation.

M=feed amount (number F of nozzles)×(reciprocal of interlace)=77.8×6=467 The distance L can be obtained using this value as follow.

$$L=467/0.1693=79.08$$

When the circumferential length of the conveyance roller is P and n is an integer, the distance L between the first pass and the second pass is obtained by $L=P/2+n\times P$. Since the first pass and the second pass can be shifted by a half cycle of the sine wave, the first pass and the second pass can be set at positions of opposite phases. That is, in this case, if the cycle of the conveyance roller is 31.6 (Φ10.1) or 52.7 (Φ16.8), the target conditions are satisfied.

The periodic phase of the conveyance roller corresponding to the head position when the cycle of the conveyance roller is 31.6 is as indicated by a reference numeral 206 in FIG. 18.

In the image forming apparatus 100 according to the present embodiment, as in the third embodiment, printing in the first pass is performed using a region 203 including the liquid discharge head 122*a* positioned on the upstream side and the upper half of the liquid discharge head 122*b* positioned at the center. In the image forming apparatus 100 according to the present embodiment, printing in the second pass is performed using a region 204 including the lower half of the liquid discharge head 122*b* and the liquid discharge head 122*c* positioned on the downstream side.

Figure 19:
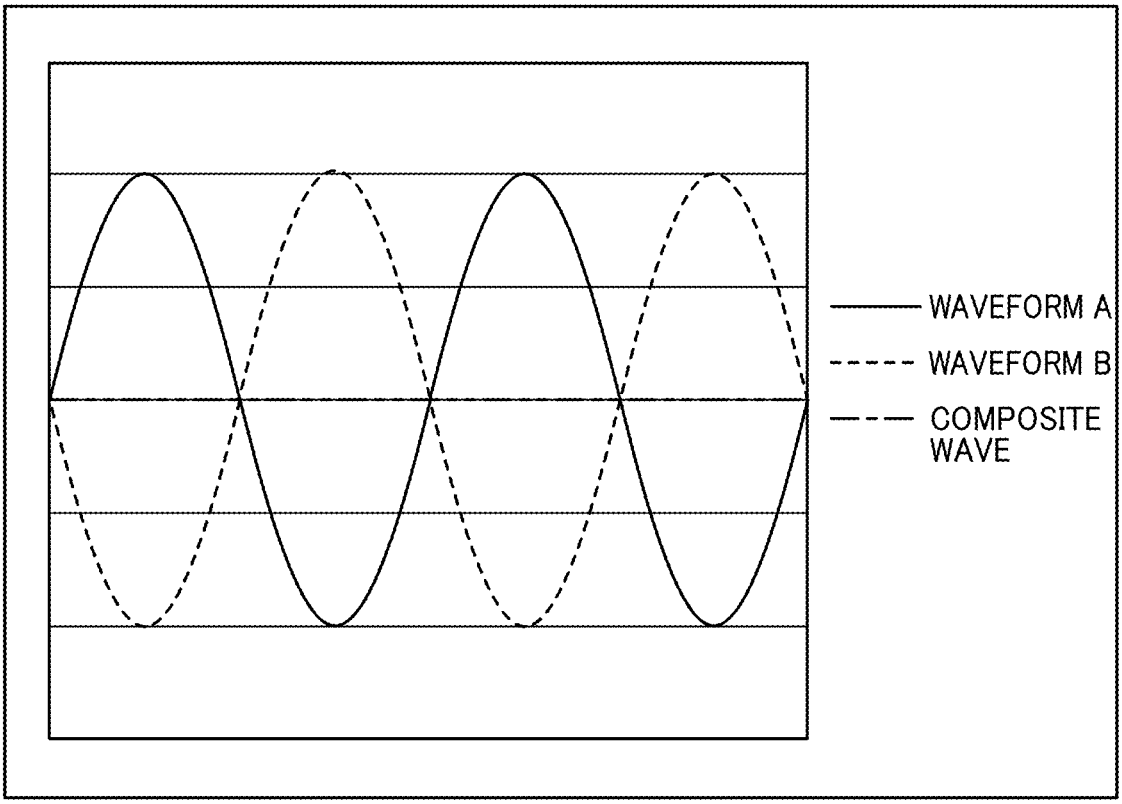
FIG. 19 is a diagram illustrating a waveform A of a sine wave corresponding to first-pass formation, a waveform B of a sine wave corresponding to second-pass formation, and a composite wave in which the waveform A and the waveform B overlap each other, according to the third embodiment of the present disclosure.

FIG. 19 is a diagram illustrating a waveform A of a sine wave corresponding to first-pass formation, a waveform B of a sine wave corresponding to second-pass formation, and a composite wave in which the waveform A and the waveform B overlap each other, according to the third embodiment. Similar to the sine wave illustrated in FIG. 8, each waveform indicates the magnitude of variation in the feed amount when compared with the ideal roller, which occurs during one actual rotation of the conveyance roller 123*a*. As illustrated in FIG. 19, since the cycle of the conveyance roller 123 is 31.63 mm, the phase of the conveyance roller 123 in the first pass and the phase of the conveyance roller 123 in the second pass are completely opposite to each other. As illustrated in FIG. 19, when the sine wave A corresponding to first-pass formation and the sine wave B corresponding to the second-pass formation are superimposed one on another, no composite wave is formed.

The control device 101 as a control unit according to the present embodiment controls the movement of the liquid discharge heads 122 in the main scanning direction and the discharge of liquid by the liquid discharge heads 122 via the print controller 108 and the main scanning motor driver 109, and also controls the driving of the conveyance roller 123*a* via the sub-scanning motor driver 110.

The control device 101 controls the liquid discharge heads 122 to discharge liquid onto the medium 40 X times (for example, twice in the example illustrated in FIGS. 6 and 7) in the main scanning direction and Y times (for example, six times in the example illustrated in FIGS. 6 and 7) in the sub-scanning direction for a total of X×Y times for each unit region corresponding to the nozzle pitch that is the pitch of the nozzles 125 in the sub-scanning direction. Here, X is an integer of two or more, and Y is an integer of two or more.

The control device 101 controls the conveyance roller 123*a* to convey the medium 40 such that the position of a liquid droplet on the medium discharged from a nozzle of the nozzles 125 by the m-th discharge (here, m is an integer not smaller than one and not greater than ((X−1)×Y)) and the position of another liquid droplet on the medium discharged from another nozzle of the nozzles 125 by the (m+Y)-th discharge are the same in the sub-scanning direction.

Here, the following relation is satisfied, where P is the circumferential length of the conveyance roller 123*a* and L is the difference between the conveyance distances of the medium 40 in the sub-scanning direction when the m-th discharge from the nozzles 125 is compared with the (m+Y)-th discharge from the nozzles 125.

The relation of $L=(n+\frac{1}{2})\times P$ is satisfied.

Accordingly, the landing position deviation of liquid droplets is less likely to occur continuously in the main scanning direction in the unit region, and the landing position deviation of liquid droplets is less likely to be perceived as banding in the image on the medium 40. Thus, the periodical banding caused by the eccentricity of the conveyance roller 123*a* can be restrained.

As described above, according to the present embodiment, when the circumferential length of the conveyance roller is P and an integer n, the distance $L=P/2+n\times P$ is satisfied.

Thus, since the cycles of sine waves in image formation in multiple passes can be set to be completely opposite in phase, the amplitude of the composite wave can be completely canceled.

Although the case of two-pass printing is described in this embodiment, the same or equivalent effect can be obtained even if the number of passes is changed as long as the number of passes is an even number. This is because the waveform A and the waveform B illustrated in FIG. 10 always form a pair in the case of even-numbered pass to cancel the amplitudes of the composite waves each other. In the case of odd-numbered pass, since there is a waveform that does not form a pair, the amplitude of the composite wave becomes larger than that of the even-numbered pass. However, since the amplification of sine waves can be restrained, the effect according to the present embodiment is not limited to the even-numbered pass.

In the present embodiment, the example in which three liquid discharge heads are configured is illustrated. However, the same or similar calculation may be performed even when the number of liquid discharge heads is changed, and the number of liquid discharge heads is not limited to three. For example, a liquid discharge apparatus according to an embodiment of the present disclosure may include only one long liquid discharge head.

In the above-described embodiment, the examples are described in which the liquid discharge apparatus according to an embodiment of the present disclosure is applied to a copier. However, in some embodiments, the image forming apparatus may be, for example, a multi-functional peripheral (MFP) having at least two of copying, printing, scanning, and facsimile transmission, a copier, a printer, a scanner, or a facsimile machine.

In the present disclosure, the term "liquid discharge apparatus" includes a liquid discharge head or a liquid discharge device (unit) and drives the liquid discharge head to discharge liquid. The term "liquid discharge apparatus" used here includes, in addition to apparatuses to discharge liquid to materials to which the liquid can adhere, apparatuses to discharge the liquid into gas (air) or liquid.

The "liquid discharge apparatus" may include at least one of devices that feed, convey, and eject a material to which liquid is adherable. The liquid discharge apparatus may further include at least one of a pre-processing device and a post-processing device.

The liquid discharge apparatus may be, for example, an image forming apparatus to form an image on a sheet by discharging ink, or a three-dimensional fabricating apparatus (solid-object fabricating apparatus) to discharge a fabrication liquid to a powder layer in which powder material is formed in layers, so as to form a three-dimensional fabrication object (solid fabrication object).

The "liquid discharge apparatus" is not limited to an apparatus in which a significant image such as a character or a figure is visualized by the discharged liquid. For example, the "liquid discharge apparatus" may be an apparatus that forms, for example, meaningless patterns or an apparatus that fabricates three-dimensional images.

The above-described term "material to which liquid is adherable" denotes, for example, a material or a medium to which liquid can adhere at least temporarily, a material or a medium to which liquid can attach and firmly adhere, or a material or a medium to which liquid can adhere and into which the liquid permeates. Specific examples of the "material to which liquid is adherable" include, but are not limited to, a recording medium such as a paper sheet, recording paper, a recording sheet of paper, a film, or cloth, an electronic component such as an electronic substrate or a piezoelectric element, and a medium such as layered powder, an organ model, or a testing cell. The "material to which liquid is adherable" includes any material to which liquid is adhered, unless particularly limited.

Examples of the material to which liquid is adherable include any materials to which liquid can adhere even temporarily, such as paper, thread, fiber, fabric, leather, metal, plastic, glass, wood, and ceramic.

The "liquid" may have any viscosity and surface tension that can be discharged from the liquid discharge head. Although not particularly limited, the "liquid" preferably has a viscosity of 30 mPa·s or less at ordinary temperature or ordinary pressure or by heating or cooling. Examples of the liquid include a solution, a suspension, or an emulsion that contains, for example, a solvent such as water and an organic solvent, a colorant such as dye and pigment, a functional material such as a polymerizable compound, a resin, and a surfactant, a biocompatible material such as deoxyribonucleic acid (DNA), amino acid, protein, and calcium, or an edible material such as a natural colorant. Such a solution, a suspension, and an emulsion are used for, e.g., inkjet ink, a surface treatment solution, a liquid for forming components of an electronic element and a light-emitting element or a resist pattern of an electronic circuit, or a material solution for three-dimensional fabrication.

The "liquid discharge apparatus" can be an apparatus in which the liquid discharge head and a material to which liquid can adhere move relatively to each other. However, the liquid discharge apparatus is not limited to such an apparatus. For example, the "liquid discharge apparatus" may be a serial head apparatus that moves the liquid discharge head or a line head apparatus that does not move the liquid discharge head.

Examples of the "liquid discharge apparatus" further include a treatment liquid coating apparatus to discharge a treatment liquid to a sheet to coat, with the treatment liquid, a sheet surface to reform the sheet surface and an injection granulation apparatus in which a composition liquid including raw materials dispersed in a solution is discharged through nozzles to granulate fine particles of the raw materials.

The above-described embodiments are illustrative and do not limit the present invention. Thus, numerous additional modifications and variations are possible in light of the above teachings. For example, elements and/or features of different illustrative embodiments may be combined with each other and/or substituted for each other within the scope of the present invention.

Any one of the above-described operations may be performed in various other ways, for example, in an order different from the one described above.

Each of the functions of the described embodiments may be implemented by one or more processing circuits or circuitry. Processing circuitry includes a programmed processor, as a processor includes circuitry. A processing circuit also includes devices such as an application specific integrated circuit (ASIC), digital signal processor (DSP), field programmable gate array (FPGA), and conventional circuit components arranged to perform the recited functions.

The invention claimed is:

1. A liquid discharge apparatus comprising:

a conveyance roller configured to convey a medium;

a liquid discharge head including a plurality of nozzles configured to discharge liquid onto the medium; and a control device configured to control the conveyance roller and the liquid discharge head, the control device being configured to:

control the conveyance roller and the liquid discharge head in a manner such that an operation of conveying the medium in a sub-scanning direction by a predetermined distance by the conveyance roller and stopping the medium and an operation of discharging the liquid from the plurality of nozzles onto the medium during movement of the liquid discharge head in a main scanning direction orthogonal to the sub-scanning direction are alternately performed;

control the liquid discharge head to discharge the liquid onto the medium X times in the main scanning direction and Y times in the sub-scanning direction for a total of X×Y times for each unit region corresponding to a nozzle pitch that is a pitch of the plurality of nozzles in the sub-scanning direction; and control the conveyance roller to convey the medium in a manner such that a position of a liquid droplet on the medium discharged from a nozzle of the plurality of nozzles by an m-th discharge and a position of another liquid droplet on the medium discharged from another nozzle of the plurality of nozzles by an (m+Y)-th discharge are same in the sub-scanning direction, where m is an integer not smaller than one and not greater than ((X−1)×Y), wherein, where P is a circumferential length of the conveyance roller and L is a difference in a conveyance distance of the medium in the sub-scanning direction when the m-th discharge from the plurality of nozzles is compared with the (m+Y)-th discharge from the plurality of nozzles, the following relation is satisfied:

$$L=(n+(\Delta\theta/2\pi))\times P,$$

where $|\pi-\Delta\theta|<60°$ and n is an integer.

2. The liquid discharge apparatus according to claim 1, wherein the following relation is satisfied:

$$L=(n+1/2)\times P.$$

3. A multi-pass liquid discharge apparatus comprising:

a conveyance roller configured to convey a medium; and a liquid discharge head including a plurality of nozzles configured to perform a plurality of scans to discharge liquid to different positions on the medium conveyed by the conveyance roller, to form an image, wherein, when L is a distance between passes in a plurality of passes to be executed for printing in a main scanning direction, M is a number of nozzles present in the distance between passes, C is a number of nozzles in one scan, D is a number of nozzles used in a total of scans, E is a number of nozzles physically usable from a configuration of the liquid discharge head, and F is a feed amount per scan calculated from the nozzles physically usable, the following relations are satisfied:

$$C=F;\text{ and}$$

$$D\leq E,\text{ and}$$

wherein a sine wave generated by rotation of the conveyance roller has a phase difference of a half cycle for each pass.

4. A multi-pass liquid discharge apparatus comprising:

a conveyance roller configured to convey a medium; and a liquid discharge head including a plurality of nozzles configured to perform a plurality of scans to discharge liquid to different positions on the medium conveyed by the conveyance roller, to form an image, wherein, when L is a distance between passes in a plurality of passes to be executed for printing in a main scanning direction, M is a number of nozzles present in the distance between passes, C is a number of nozzles in one scan, D is a number of nozzles used in a total of scans, E is a number of nozzles physically usable from a configuration of the liquid discharge head, and F is a feed amount per scan calculated from the nozzles physically usable, the following relations are satisfied:

$$C=F;\text{ and}$$

$$D\leq E,\text{ and}$$

wherein an amplitude of a composite wave obtained by superimposing a first sine wave generated by rotation of the conveyance roller in formation of a first pass and a second sine wave generated by rotation of the conveyance roller in formation of a second pass is smaller than an amplitude of each of the first sine wave and the second sine wave.

5. The multi-pass liquid discharge apparatus according to claim 3, wherein a sine wave generated by rotation of the conveyance roller in formation of each pass has a phase difference of θ, the following relation is satisfied:

$$|\pi-\Delta\theta|<60°.$$

6. The multi-pass liquid discharge apparatus according to claim 3, wherein, where P is a circumferential length of the conveyance roller and n is an integer, the following equation is satisfied:

$$L=P/2|n\times P.$$

7. The multi-pass liquid discharge apparatus according to claim 3, wherein the liquid discharge head is configured to form the image by a multi-pass method for even-numbered passes.

* * * * *